US011317683B2

(12) United States Patent
Suzuki et al.

(10) Patent No.: US 11,317,683 B2
(45) Date of Patent: May 3, 2022

(54) METHOD FOR SEWING SLIDE FASTENER, AND SLIDE FASTENER PRODUCT

(71) Applicants: JUKI CORPORATION, Tama (JP); YKK CORPORATION, Tokyo (JP)

(72) Inventors: Ichirou Suzuki, Fuchu (JP); Wataru Kawaguchi, Sagamihara (JP)

(73) Assignees: JUKI CORPORATION, Tokyo (JP); YKK CORPORATION, Tokyo (JP)

( * ) Notice: Subject to any disclaimer, the term of this patent is extended or adjusted under 35 U.S.C. 154(b) by 114 days.

(21) Appl. No.: 16/755,637

(22) PCT Filed: Oct. 5, 2018

(86) PCT No.: PCT/JP2018/037338

§ 371 (c)(1),
(2) Date: Apr. 13, 2020

(87) PCT Pub. No.: WO2019/073919

PCT Pub. Date: Apr. 18, 2019

(65) Prior Publication Data

US 2021/0153609 A1 May 27, 2021

(30) Foreign Application Priority Data

Oct. 13, 2017 (JP) ..... JP2017-199546

(51) Int. Cl.
*A44B 19/02* (2006.01)
*A41H 37/06* (2006.01)

(52) U.S. Cl.
CPC ..... *A44B 19/02* (2013.01); *A41H 37/06* (2013.01)

(58) Field of Classification Search
CPC ..... A44B 19/02; A44B 19/403; A44B 19/46; A44B 19/14; A41H 37/06
See application file for complete search history.

(56) References Cited

U.S. PATENT DOCUMENTS 3,132,398 A * 5/1964 Schwendt et al. ... A44B 19/403 24/408
4,033,014 A 7/1977 Manning
(Continued)

FOREIGN PATENT DOCUMENTS

JP S4013870 Y 5/1965
JP 2016168190 A 9/2016
(Continued)

OTHER PUBLICATIONS

International Preliminary Report on Patentability (IPRP) (and English language translation thereof) dated Apr. 14, 2020 issued in International Application No. PCT/JP2018/037338.
(Continued)

*Primary Examiner* — Robert Sandy
*Assistant Examiner* — Rowland Do
(74) *Attorney, Agent, or Firm* — Holtz, Holtz & Volek PC

(57) ABSTRACT

A method for sewing a slide fastener includes forming end edge portion needle drop points in at least two positions, within an overlapped portion in which the work piece is folded, within a range more toward a tip side of an end edge portion of the work piece than half of an overlapped width, and within a range on an inner side of a width of a leg portion of an interlocking element. Sewing is performed with sewing thread passing from a head portion needle drop point to the end edge portion needle drop point of one end portion and sewing thread passing from the end edge portion needle drop point of another end portion to the head portion needle drop point of an adjacent interlocking element each passing either side of the leg portion.

22 Claims, 16 Drawing Sheets

(56) References Cited

U.S. PATENT DOCUMENTS

| | | | | |
|---|---|---|---|---|
| 10,016,027 | B2 | 7/2018 | Yoneoka | |
| 2013/0160249 | A1* | 6/2013 | Aiko | A44B 19/406<br>24/395 |
| 2018/0192748 | A1 | 7/2018 | Yoneoka | |
| 2018/0317614 | A1 | 11/2018 | Hosokawa et al. | |
| 2019/0357638 | A1* | 11/2019 | Sho | A44B 19/403 |

FOREIGN PATENT DOCUMENTS

| | | | |
|---|---|---|---|
| WO | 2014118948 | A1 | 8/2014 |
| WO | 2017094145 | A1 | 6/2017 |

OTHER PUBLICATIONS

International Search Report (ISR) (and English translation thereof) dated Jan. 8, 2019 issued in International Application No. PCT/JP2018/037338.

Written Opinion dated Jan. 8, 2019 issued in International Application PCT/JP2018/037338.

Chinese Office Action (and English language translation thereof) dated Jul. 2, 2021, issued in counterpart Chinese Application No. 201880057698.7.

* cited by examiner

METHOD FOR SEWING SLIDE FASTENER, AND SLIDE FASTENER PRODUCT

TECHNICAL FIELD

The present invention relates to a method for sewing a slide fastener and a slide fastener product employing the above method.

BACKGROUND ART

There is a slide fastener provided with a pair of interlocking element linked members in which a plurality of interlocking elements are linked with a string portion and a slider which connects and separates the pair of interlocking element linked members.

The interlocking elements of the slide fastener includes leg portions fixed to the string portion and head portions which interlock with each other when the pair of interlocking element linked members are connected. Each of the interlocking elements in each interlocking element linked member is fixed to the string portion in a state with all of the head portions pointing the same direction (for example, Patent Document 1).

CITATION LIST

Patent Literature

Patent Document 1: JP S40-13870 Y

SUMMARY OF INVENTION

Technical Problem

Such slide fastener is sewn by sewing the interlocking element linked member to an end edge of a sheet material as a work piece by overlock stitching using an overlock sewing machine.

However, when the interlocking element linked member is sewn by overlock stitching, the binging force on each interlocking element with relation to the work piece is weak. The head portion of the interlocking elements shake around the axis along the longitudinal direction of the interlocking element linked member and shake along the longitudinal direction of the interlocking element linked member. Consequently, smooth operation using the slider is difficult when the interlocking element linked members are linked or separated.

The purpose of the present invention is to suitably sew the interlocking element linked member.

Solution to Problem

According to aspect 1, a method for sewing a slide fastener to sew an interlocking element linked member of a slide fastener to an end edge portion of a work piece, the slide fastener including the interlocking element linked member in which a plurality of interlocking elements are linked with a string portion, wherein the interlocking element includes a leg portion supported by the string portion and a head portion which interlocks with an interlocking element of another interlocking element linked member as a pair and which projects from the leg portion, the sewing method including: by sewing, forming a head portion needle drop point on a head portion side of the interlocking element with relation to the string portion and an end edge portion needle drop point on an end edge portion side of the work piece with relation to the string portion, wherein the end edge portion needle drop points are provided in at least two positions, which are a one end portion and another end portion, within an overlapped portion folding the work piece, within a range toward a tip side of the end edge portion than half of an overlapped width in the overlapped portion with relation to a projecting direction of the head portion of the interlocking element, and within a range on an inner side of a width of the leg portion of the interlocking element in a longitudinal direction of the string portion; and sewing in which sewing thread passing from the head portion needle drop point to the end edge portion needle drop point of the one end portion and sewing thread passing from the end edge portion needle drop point of the another end portion to the head portion needle drop point of an adjacent interlocking element each pass a side on either side of the leg portion of the interlocking element in the longitudinal direction of the string portion.

According to aspect 2, a method for sewing a slide fastener to sew an interlocking element linked member of a slide fastener to an end edge portion of a work piece, the slide fastener including the interlocking element linked member in which a plurality of interlocking elements are linked with a string portion, wherein the interlocking element includes a leg portion supported by the string portion and a head portion which interlocks with an interlocking element of another interlocking element linked member as a pair and which projects from the leg portion, the sewing method comprising: by sewing, forming a head portion needle drop point on a head portion side of the interlocking element with relation to the string portion and an end edge portion needle drop point on an end edge portion side of the work piece with relation to the string portion, wherein the end edge portion needle drop point is provided in two positions which are one end portion and another end portion in a range on an inner side of a width of the leg portion of the interlocking element in the longitudinal direction of the string portion and a position which is in a range farther from the interlocking element than the above two positions and which is in a range on the inner side of the width of the leg portion of the interlocking element; and sewing in which sewing thread from the head portion needle drop point to the end edge portion needle drop point provided in the one end portion and sewing thread from the end edge portion needle drop point provided in the other end portion to the head portion needle drop point of the adjacent interlocking element each pass a side on either side of the leg portion of the interlocking element in a longitudinal direction of the string portion.

Aspect 3 describes the method for sewing the slide fastener according to aspect 2, wherein the end edge needle drop point is within an overlapped portion folding the work piece.

Aspect 4 describes the method for sewing the slide fastener according to any one of aspects 1 to 3, wherein, the slide fastener includes a pair of interlocking element linked members and a slider which links and separates the pair of interlocking element linked members, and the end edge portion needle drop point provided in the one end portion and the end edge portion needle drop point provided in the other end portion are provided within a range in which the slider passes over the work piece.

Aspect 5 describes the method for sewing the slide fastener according to any one of aspects 1 to 4, wherein a stitch of the sewing is formed by a stitch of lock stitching.

Aspect 6 describes the method for sewing the slide fastener according to aspect 5, wherein the stitch of the lock stitching is formed by zigzag sewing.

According to aspect 7, a slide fastener product includes: a slide fastener including, a pair of interlocking elements in which a plurality of interlocking elements are linked with a string portion; and a slider in which the pair of interlocking element linked members are linked and separated, and a sewn product wherein each interlocking element linked member in the pair of interlocking element linked members are sewn separately in one of two positions of the end edge portion, wherein, the interlocking element includes a leg portion supported by the string portion and a head portion which interlocks with an interlocking element of another interlocking element linked member as a pair and which projects from the leg portion, a head portion needle drop point is formed by sewing on a head portion side of the interlocking element with relation to the string portion and an end edge portion needle drop point is formed by sewing on an end edge portion side of the work piece with relation to the string portion, the end edge portion needle drop points are provided in at least two positions, which are a one end portion and another end portion, within an overlapped portion folding the work piece, within a range toward a tip side of the end edge portion than half of an overlapped width in the overlapped portion with relation to a projecting direction of the head portion of the interlocking element, and within a range on an inner side of a width of the leg portion of the interlocking element in a longitudinal direction of the string portion, and sewing thread passing from the head portion needle drop point to the end edge portion needle drop point of the one end portion and sewing thread passing from the end edge portion needle drop point of the another end portion to the head portion needle drop point of an adjacent interlocking element each pass a side on either side of the leg portion of the interlocking element.

According to aspect 8, a slide fastener product includes: a slide fastener including, a pair of interlocking elements in which a plurality of interlocking elements are linked with a string portion; and a slider in which the pair of interlocking element linked members are linked and separated, and a sewn product wherein each interlocking element linked member in the pair of interlocking element linked members are sewn separately in one of two positions of the end edge portion, wherein, the interlocking element includes a leg portion supported by the string portion and a head portion which interlocks with an interlocking element of another interlocking element linked member as a pair and which projects from the leg portion, a head portion needle drop point is formed by sewing on a head portion side of the interlocking element with relation to the string portion and an end edge portion needle drop point is formed by sewing on an end edge portion side of the work piece with relation to the string portion, the end edge portion needle drop point is provided in two positions which are one end portion and another end portion in a range on an inner side of a width of the leg portion of the interlocking element in the longitudinal direction of the string portion and a position which is in a range farther from the interlocking element than the above two positions and which is in a range on the inner side of the width of the leg portion of the interlocking element, and sewing thread from the head portion needle drop point to the end edge portion needle drop point provided in the one end portion and sewing thread from the end edge portion needle drop point provided in the other end portion to the head portion needle drop point of the adjacent interlocking element each pass a side on either side of the leg portion of the interlocking element.

Aspect 9 describes the slide fastener product according to aspect 8, wherein the end edge needle drop point is within an overlapped portion folding the work piece along the end edge portion.

Aspect 10 describes the slide fastener product according to any one of aspects 7 to 10, wherein the end edge portion needle drop point provided in the one end portion and the end edge portion needle drop point provided in the other end portion are provided within a range in which the slider passes over the work piece.

Aspect 11 describes the slide fastener product according to any one of aspects 7 to 10, wherein a stitch of the sewing is formed by a stitch of lock stitching.

Aspect 12 describes the slide fastener product according to aspect 11, wherein the stitch of the lock stitching is formed by zigzag sewing.

Advantageous Effects of Invention

According to the present invention, by forming the head portion needle drop point and the end edge portion needle drop point, the movement of the interlocking element along the longitudinal direction of the interlocking element linked member, the shaking of the head portion of the interlocking element along the longitudinal direction of the interlocking element linked member, and the shaking of the head portion of the interlocking element around the axis in the longitudinal direction of the interlocking element can be reduced and suppressed. Therefore, suitable sewing of the slide fastener is realized and the linking or separating operation by the slider can be performed smoothly in the slide fastener product.

DESCRIPTION OF EMBODIMENTS

[Summary of Slide Fastener Product]

Below, a slide fastener product 1 and a zigzag sewing machine 100 suitable for sewing the slide fastener product 1 are described in detail as an embodiment of the present invention.

Figure 1:
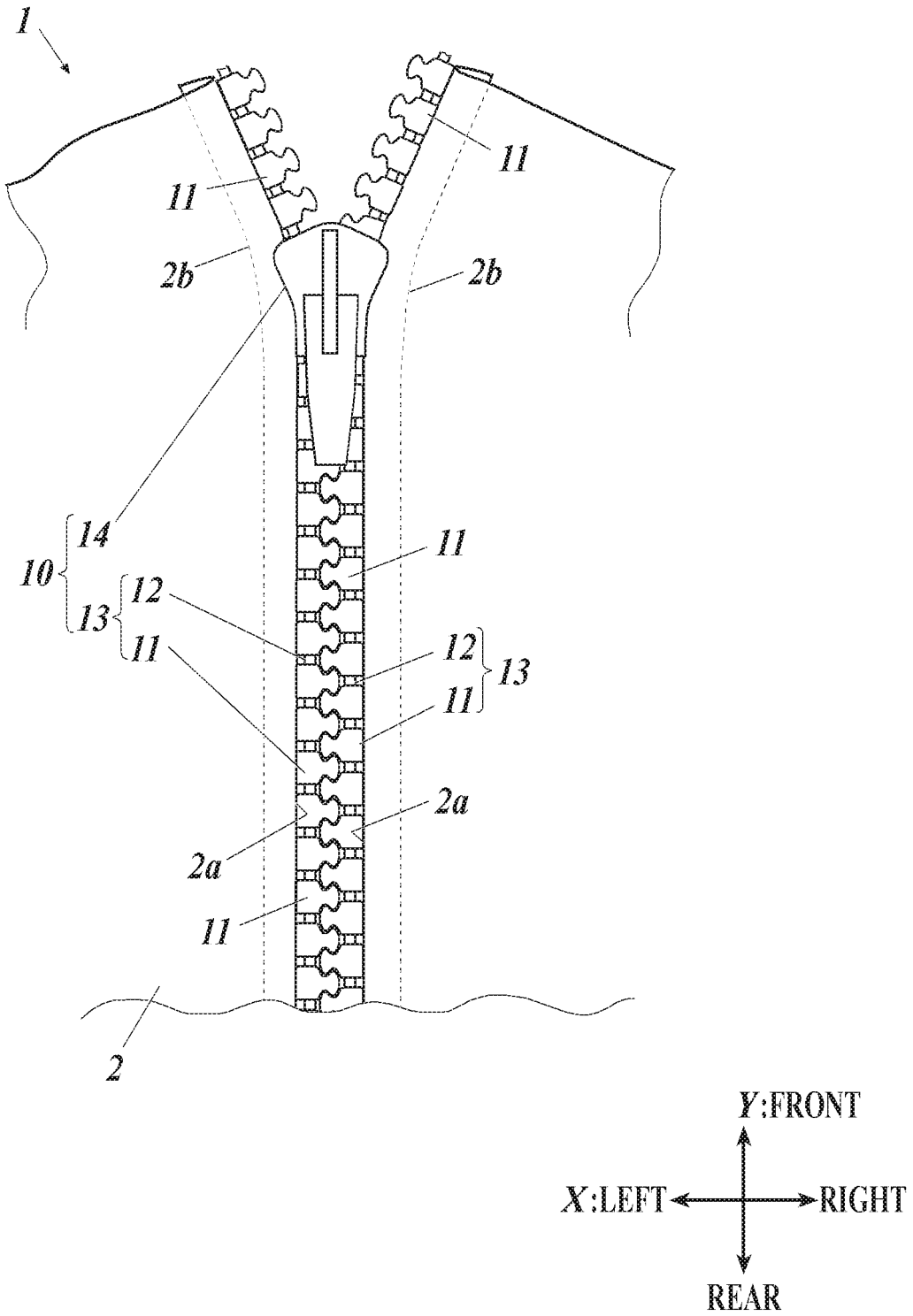
FIG. 1 is a planar view of a slide fastener according to an embodiment of the invention.

FIG. 1 is a planar view of the slide fastener product 1.

Daily necessities such as clothes, shoes, bags and other non-daily necessities may be an object considered as the slide fastener product 1. That is, any product in which a slide fastener 10 can be used for the purpose of connecting work pieces in a sheet shape and opening and closing notch portions and openings of the work piece may be the object.

The slide fastener product 1 includes the slide fastener 10 and a work piece 2 on which the slide fastener 10 is sewn.

The work piece 2 of the slide fastener product 1 may be any sheet shaped material on which sewing can be performed. For example, the work piece 2 may be cloth, textile, leather, synthetic resin, or the like.

The work piece 2 includes two end edge portions 2*a* opposed to each other. An overlapped portion 2*b* is formed in the end edge portion 2*a*. In the overlapped portion 2*b*, a material of the work piece 2 is folded toward the rear surface side.

Then, each interlocking element linked member 13 in a pair of the interlocking element linked members 13 of the slide fastener 10 is sewn to each end edge portion 2*a* along the end edge portion 2*a*.

The present embodiment shows each end edge portion 2*a* of the work piece 2 in the slide fastener product 1 in a straight line shape. The shape of the end edge portions 2*a* is one example, and the slide fastener 10 can be applied in other curved shapes such as an arched shape.

In the description regarding the slide fastener product 1 and the slide fastener 10, a direction along the end edge portion 2*a* of the work piece 2 is a Y-axis direction, a direction parallel to a plane of the work piece and orthogonal to the Y-axis direction is a X-axis direction, and a direction orthogonal to a plane of the work piece is a Z-axis direction.

Further, the pair of interlocking element linked members 13 of the slide fastener 10 is sewn to the end edge portion 2*a* of the work piece 2 along the Y-axis direction. An operation direction in which a slider 14 connects the interlocking element linked members 13 is to be "front" (up in the sheet of FIG. 1), the operation direction to separate is to be "rear" (down in the sheet of FIG. 1). Facing the front, the left hand side is to be "left", and the right hand side is to be "right". Orthogonal to the sheet, a near side of the sheet in FIG. 1 is to be "up", and the rear side of the sheet is to be "down".

According to the above definition, FIG. 1 shows the work piece 2 with the front surface of the work piece 2 facing the upper side and the rear surface of the work piece 2 facing the lower side.

[Slide Fastener]

Figure 2:
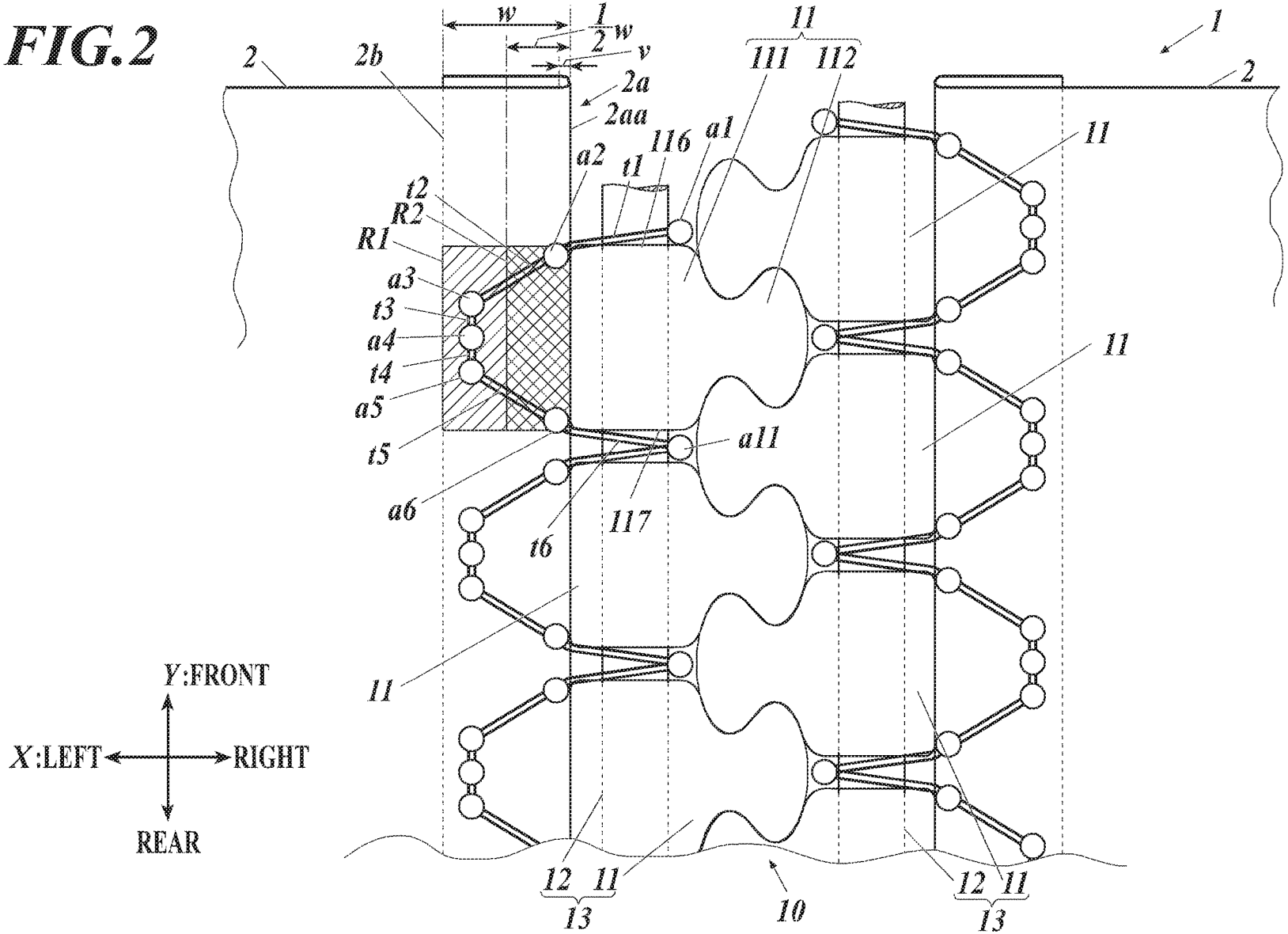
FIG. 2 is an enlarged planar view showing a slide fastener product.

FIG. 2 is an enlarged planar view of the slide fastener 10.

As shown in FIG. 1 and FIG. 2, the slide fastener 10 includes the pair of interlocking element linked members 13 in which a plurality of interlocking elements 11 are linked by a string portion 12, and the slider 14 which connects and separates the pair of interlocking element linked members 13.

The interlocking elements 11 include a leg portion 111 through which the string portion 12 penetrates, and a head portion 112 projecting from the leg portion 111. The interlocking element linked member 13 includes the plurality of interlocking elements 11 fixed to the string portion 12 at an even interval with the head portion 112 pointing the same direction.

The string portion 12 which links the interlocking elements 11 is a string shape with strength and low elasticity. Material such as monofilament, multifilament, twisted thread, twisted string, or a composite material of the above can be used, and the structure or type of the string is not limited.

The string portion 12 can be a soft material which easily bends. In a state where the string portion 12 has flexibility but external force is not received, the string portion 12 may include stiffness enough to maintain a straight shape.

The pair of interlocking element linked members 13 is sewn to each end edge portion 2*a* of the work piece 2 so that the head portions 112 of the interlocking elements 11 oppose to each other.

The slider 14 is formed with a guide path at the front end portion so that each interlocking element linked member 13 can pass through separately. The guide paths are joined inside the slider 14, and become one guide path at the rear end portion.

That is, if the separated pair of interlocking element linked members 13 enters the guide paths from the front end portion side of the slider 14, the head portions 112 of each of the interlocking elements 11 in the interlocking element linked members 13 interlock with each other, and the pair of interlocking element linked members 13 are linked to each other before passing the rear end portion of the slider 14.

On the other hand, if the connected pair of interlocking element linked members 13 enters the guide path from the rear end portion side of the slider 14, the interlocked state of the head portions 112 of each of the interlocking elements 11 in the interlocking element linked members 13 is released, and the pair of interlocking element linked members 13 are separated from each other before passing the front end portion of the slider 14.

Figure 3:
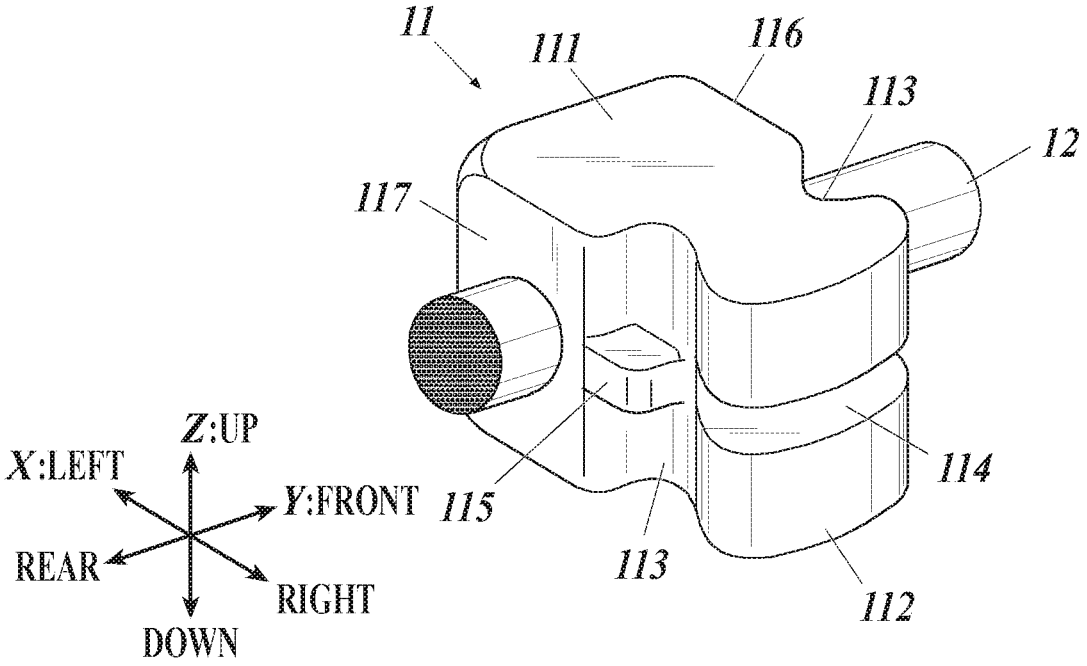
FIG. 3 is a perspective view showing an interlocking element.

FIG. 3 is a perspective view showing the interlocking element 11. FIG. 3 shows the interlocking element 11 of the interlocking element linked member 13 on the left side in FIG. 1 and FIG. 2. According to FIG. 3, the sections in the interlocking element 11 are described according to the direction of the interlocking element 11 of the interlocking element linked member 13 on the left side.

In the interlocking element 11 of the interlocking element linked member 13 on the right side, only the left and right directions of the head portion 112 are opposite, and the structure itself is the same.

The interlocking element 11 includes, for example, a thermoplastic resin such as polyamide, polyacetal, polypropylene, polybutylene terephthalate. The interlocking elements 11 are formed as one with the string portion 12 by injection molding to the string portion 12.

The interlocking element 11 is not limited to the thermoplastic resin, and the interlocking element 11 is formed by performing die-cast molding using metal such as aluminum alloy, zinc alloy or magnesium alloy.

As shown in FIG. 2 and FIG. 3, the interlocking element 11 includes a leg portion 111 in a substantial rectangular solid shape, and the string portion 12 penetrates from one side 116 to the other side 117 in the width direction to be fixed to the leg portion 111.

The "width direction of the leg portion 111" shows the direction along the longitudinal direction of the string portion 12.

The left end portion of the leg portion 111 faces the end edge portion 2*a* of the work piece 2 and the right end portion includes a head portion 112 projecting to the right. Then, a concave portion 113 caved along the Y-axis direction is formed throughout the entire length of the Z-axis direction on both sides of the front and the rear in the boundary portion of the head portion 112 and the leg portion 111.

The head portion 112 is in a shape projected to the right and with a base portion constricted on both sides by the concave portion 113. The front end portion and the rear end portion of the head portion 112 are both in a swelled shape in a curve from a planar view.

The shape of the concave portion 113 from the planar view matches with the shape of the front end portion and the rear end portion of the head portion 112 from the planar view, and the shape is caved in a curve.

Therefore, in the linked state of the pair of the interlocking element linked members 13, the front end portion or the rear end portion of two adjacent head portions 112 of the interlocking element 11 in the other interlocking element linked member 13 is fitted in the concave portion 113 on both sides of the head portion 112 of the interlocking element 11 of one interlocking element linked member 13.

With this, in the linked state of the pair of interlocking element linked members 13, the head portions 112 of the interlocking elements 11 are bound to each other in the front and rear direction, and the pair of interlocking element linked members 13 are maintained so as not to be separated.

As shown in FIG. 2, the plurality of interlocking elements 11 in the interlocking element linked members 13 are linked to the string portion 12 with a certain interval in between each other. The size of the interval of the interlocking elements 11 is set so that when the pair of interlocking element linked members 13 are linked, the head portion 112 of the interlocking element 11 of the interlocking element linked member 13 is fitted in the concave portion 113 of the other interlocking element linked member 13 without a gap.

Figure 4:
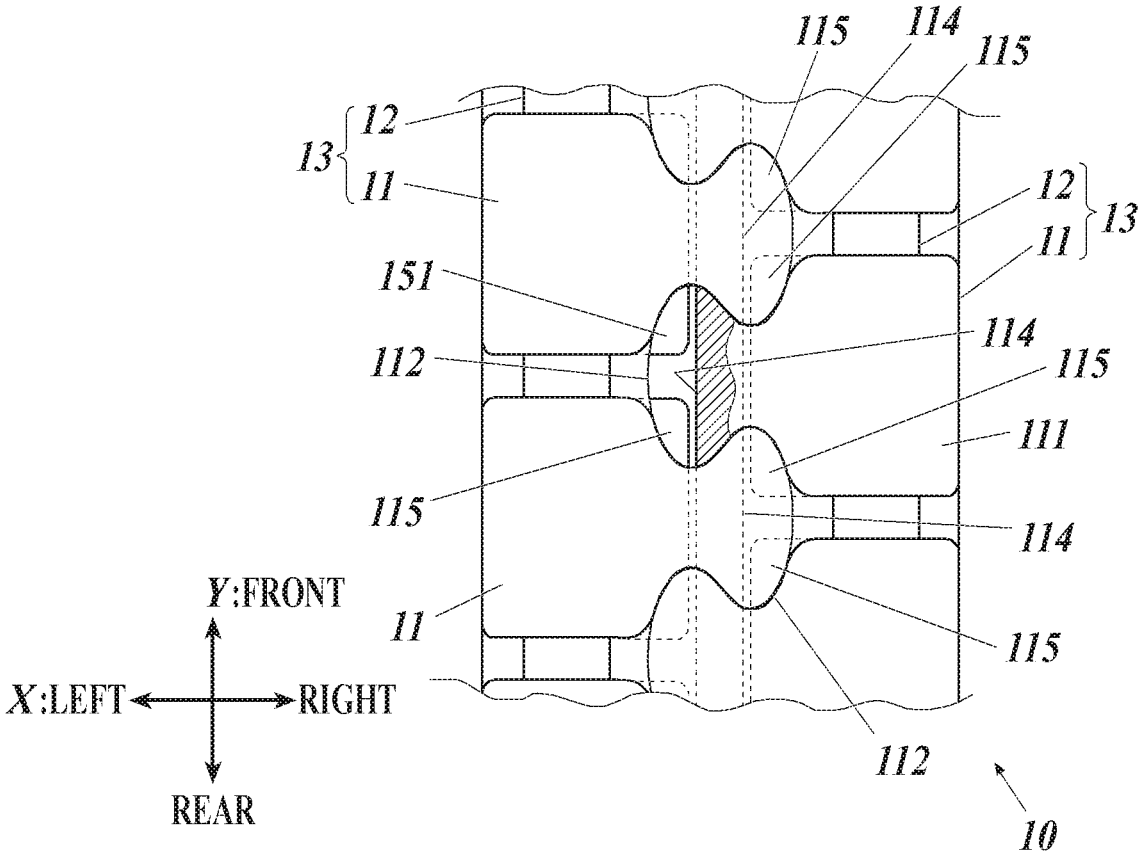
FIG. 4 is an enlarged planar view cutting out a portion of an interlocked state of the interlocking elements.

FIG. 4 is an enlarged planar view cutting out a portion of the interlocked state of the interlocking elements 11. As shown in FIG. 3 and FIG. 4, a concave groove 114 is formed along the Y-axis direction in a projecting end portion (right end portion) of the head portion 112 of the interlocking element 11.

Further, a plate-shaped protrusion 115 projecting to the right at a height the same as the concave groove 114 is formed on the inner side of the concave portion 113 on both sides in the front and the rear of the interlocking elements 11.

Such concave groove 114 and protrusion 115 are structured so that if the pair of interlocking element linked members 13 are linked, the projection 115 on both sides of the front and the rear of the interlocking element 11 of the interlocking element linked member 13 fits in the concave groove 114 of the interlocking element 11 in the other interlocking element linked member 13.

With this, the head portion 112 of the interlocking element 11 in one interlocking element linked member 13 and the head portion 112 of the interlocking element 11 in the other interlocking element linked member 13 are bound to each other in the Z-axis direction. Even if external force is applied in the Z-axis direction, the linked state is effectively maintained.

Example (1) of Preferable Needle Drop Point in Sewing Slide Fastener

Figure 5:
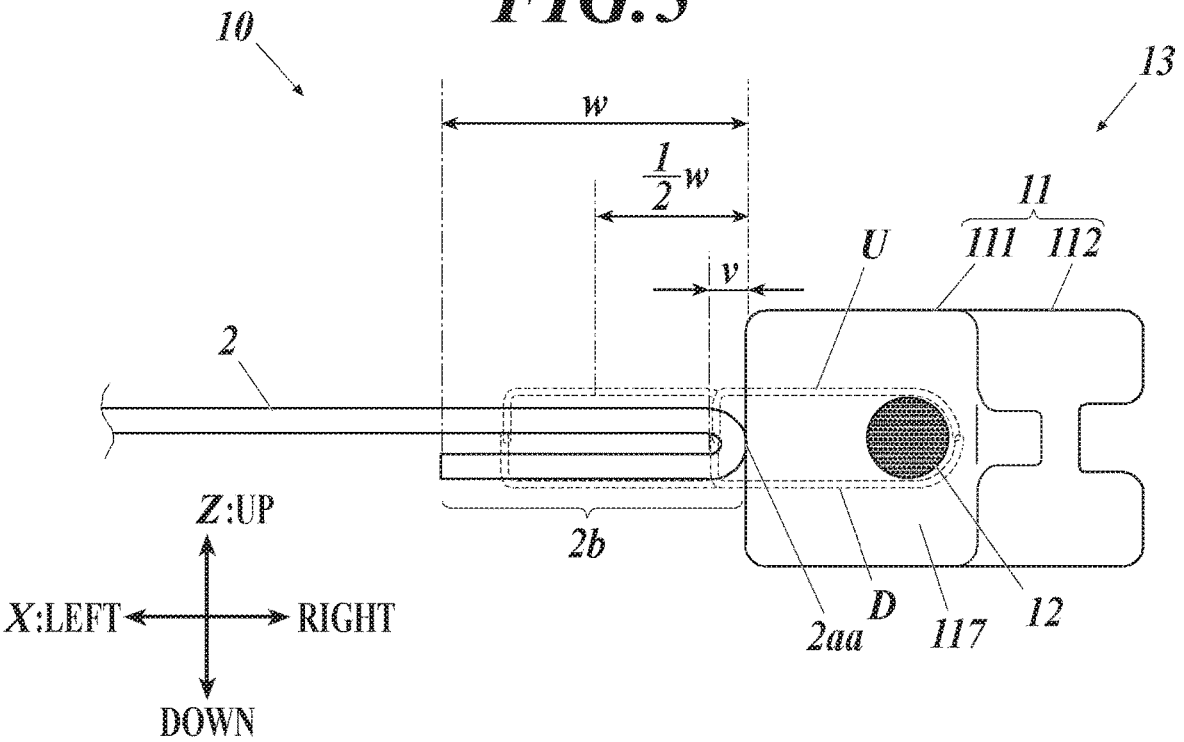
FIG. 5 is a diagram viewing from the rear a needle drop point of the stitch in the interlocking element linked member on the left side.

The sewing method of the slide fastener 10 and the needle drop point of the stick to be formed according to an example (1) is described based on FIG. 2 and FIG. 5. FIG. 5 is a rear view of the needle drop point of the stitch in the interlocking element linked member 13 on the left side.

The interlocking element linked member 13 of the slide fastener 10 is sewn on the end edge portion 2*a* of the work piece 2 by stitches of lock stitching formed by the later described zigzag sewing machine 100. Therefore, the stitches on the front surface side of the work piece 2 is formed by a needle thread U, and the stitches on the rear surface side are formed by a bobbin thread D.

As shown in FIG. 2, when the interlocking element linked member 13 is sewn, by sewing with 2-step zigzag sewing using the zigzag sewing machine 100, for one interlocking element 11, a head portion needle drop point a1 to the head portion 112 side of the interlocking element 11 with relation to the string portion 12 is formed, and end edge portion needle drop points a2 to a6 to the end edge portion 2*a* side of the work piece 2 with relation to the string portion 12 are formed. Such needle drop points are formed in order from a1 to a6.

Then, the interlocking element 11 is fixed to the work piece 2 by the stitches t1 to t6 formed by the needle thread U and the bobbin thread D.

t1: stitch formed between needle drop points a1 to a2
t2: stitch formed between needle drop points a2 to a3
t3: stitch formed between needle drop points a3 to a4
t4: stitch formed between needle drop points a4 to a5
t5: stitch formed between needle drop points a5 to a6
t6: stitch formed between needle drop points a6 to a11

(head portion needle drop point a1 of the interlocking element 11 on the rear adjacent side, for the purpose of description and discrimination, also described as "all" in the description and FIG. 2, similarly applies to later described FIG. 6 to FIG. 10)

The sewing is not limited to 2-step zigzag sewing, and zigzag sewing of two or more points can be applied.

In the Y-axis direction, the head portion needle drop point a1 is in a position near the side 116 on the front side of the leg portion 111 in the interlocking element 11 as the fixed target. In the X-axis direction, the head portion needle drop point a1 is in a position near the string portion 12 on the right side of the string portion 12.

Regarding such head portion needle drop point a1, the zigzag sewing machine 100 enters the needle in a position where there is nothing. The sewing needle of the sewing machine 100 is able to contact the string portion 12 and the interlocking element 11 when the sewing needle is raised to form a loop of the thread needle U, and can be caught by the hook to be twined to the bobbin thread D. Therefore, a knot can be formed with the needle thread U and the bobbin thread D in the head portion needle drop point a1.

The end edge portion needle drop points a2 to a6 are all positioned in the region R1 which is in the overlapped portion 2*b* of the work piece 2 and which is within the range of the width of the leg portion 111 in the Y-axis direction in the interlocking element 11 as the fixed target.

Further, preferably, as for only the following two points, specifically, the end edge portion needle drop points a2 and a6 among the end edge portion needle drop points a2 to a6, the two points are positioned in the region R2 on a tip 2*aa* side of the end edge portion 2*a* in the region R1 with a width w/2 which is half of an overlapped width w of the overlapped portion 2*b* of the work piece 2 as the center. In FIG. 2, the regions R1 and R2 are displayed with hatching, but this is to clearly show the range of each region.

The above two end edge portion needle drop points a2 and a6 are separately positioned in a one end portion (front end portion) and another end portion (rear end portion) in the Y-axis direction in the region R2.

Preferably, the end edge portion needle drop points a2 and a6 are positioned toward the front side and toward the rear side as much as possible in the region R2.

Preferably, the end edge portion needle drop points a2 and a6 are positioned toward the tip 2*aa* of the end edge portion 2*a* as much as possible in the X-axis direction in the region R2.

For example, as shown in FIG. 5, when the work piece 2 is folded and the overlapped portion 2*b* is formed, a flat portion along the X-Y plane and a portion curved by the fold are formed in the end edge portion 2*a* of the work piece 2.

Preferably, the end edge portion needle drop points a2 and a6 are positioned in the X-axis direction within the range of the width v in the portion curved by the fold.

The three points of the end edge portion needle drop points a3 to a5 are within the region in the region R1 and farther from the tip 2*aa* of the end edge portion 2*a* than the region R2. The three points are positioned aligned in one row along the Y-axis direction within the range between the end edge portion needle drop point a2 and the end edge portion needle drop point a6 in the Y-axis direction.

Sewing with the zigzag sewing machine 100 is performed as follows. The end edge portion 2*a* of the work piece 2 and the string portion 12 of one interlocking element linked member 13 are aligned along the Y-axis direction close to each other. The above is fed forward while the sewing needle swings along the X-axis direction. From the interlocking element 11 on the front side, the needle is entered in order from the needle drop point a1 to the needle drop point a6 for each interlocking element 11. The stitches t1 to t6 of the lock stitching are formed.

As a result of the sewing, the stitch t1 formed by the needle thread U and the bobbin thread D between the needle drop points a1 to a2, and the stitch t6 formed by the needle thread U and the bobbin thread D between the needle drop points a6 to a11 are formed to pass along the sides 116 and 117 on both sides of the leg portion 111 in the Y-axis direction in the interlocking element 11 as the fixed target.

This is due to the two points of the end edge portion needle drop points a2 and a6 being positioned in the front end portion and the rear end portion in the region R2.

Figure 6:
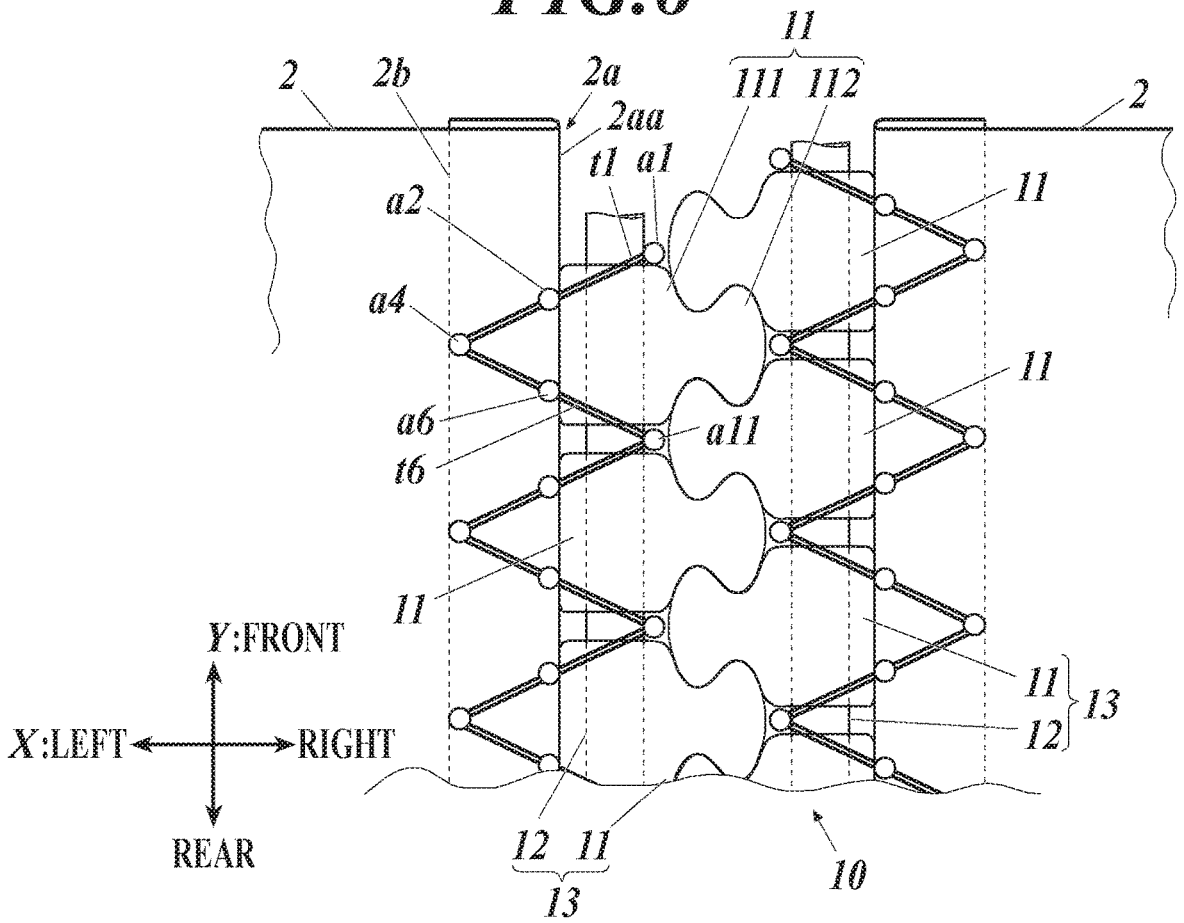
FIG. 6 is an enlarged planar view showing a comparative example (1) of the slide fastener product.

For example, as shown in comparative example (1) in FIG. 6, if the two end edge portion needle drop points a2 and a6 are separated from the front end portion and the rear end portion and close to each other in the center portion in the region R2, the stitches t1 and t6 are not formed along the sides 116 and 117, and cross the upper surface of the leg portion 111 (the bobbin thread D crosses the lower surface). In FIG. 6, the illustration of the end edge portion needle drop points a3 and a5 are omitted.

However, as shown in FIG. 2, if the end edge portion needle drop points a2 and a6 are positioned in the front end portion and the rear end portion in the region R2, the stitch t1 and the stitch t6 of the needle thread U and the bobbin thread D can be formed to pass along the sides 116 and 117.

Since the stitch t1 and the stitch t6 are formed to pass along the sides 116 and 117, the needle thread U and the bobbin thread D which form the stitches t1 and t6 are in contact with the corner of the work piece 2 side of the leg portion 111 in the interlocking element 11.

With this, the needle thread U and the bobbin thread D hold the interlocking element 11 from the sides 116 and 117 so as to enwrap the interlocking element 11. Therefore, the movement of the interlocking element 11 moving along the Y-axis direction is suppressed, the head portion 112 of the interlocking element 11 shaking along the Y-axis direction is suppressed, and the head portion 112 of the interlocking element 11 shaking around the Y-axis is suppressed. Therefore, the linking and separating operation of the slide fastener product 1 can be performed smoothly by the slider 14.

On the other hand, if the stitch t1 and the stitch t6 are formed to cross as shown in FIG. 6, the needle thread U and the bobbin thread D which form the stitches t1 and t6 do not come into contact with the corner of the leg portion 111. Therefore, the movement and the shaking in various directions cannot be suppressed. Moreover, the smooth linking or separating by the slider 14 becomes difficult.

Figure 7:
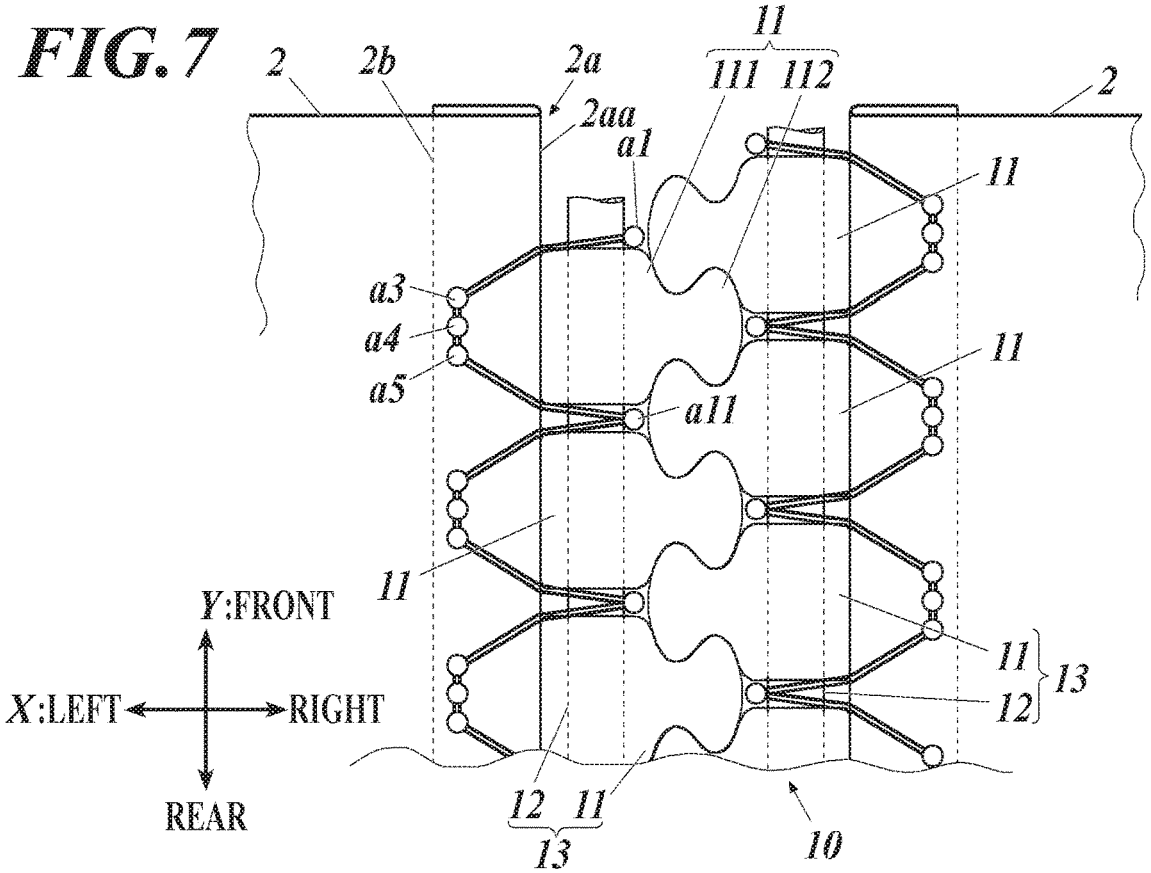
FIG. 7 is an enlarged planar view showing a comparative example (2) of the slide fastener product.

For the purpose of comparison, FIG. 7 shows a comparative example (2) in which sewing is performed by forming stiches with the needle drop points a1, a3, a4, and a5, and excluding the needle drop points a2 and a6 in the interlocking element 11.

According to the comparative example (2), even if the needle thread U and the bobbin thread D in the stitch formed between the needle drop points a1 to a3 and the needle thread U and the bobbin thread D in the stitch formed between the needle drop points a5 to a11 are formed to pass along the sides 116 and 117, and are formed to come into contact with the corner on the work piece 2 side of the leg portion 111, the effect similar to the stitches t1 and t6 cannot be obtained.

According to the comparative example (2), there are no needle drop points a2 and a6, and the needle drop points a3 and a5 are separated from the corner in the leg portion 111 of the interlocking element 11. Therefore, the effect of binding the interlocking element 11 through the corner is small. There is a high possibility that the stitch is formed over the corner and crosses the upper surface of the leg portion 111. Therefore, it is not possible to sufficiently suppress the above-described movement and the shaking of the interlocking element 11.

According to the preferable needle drop point shown in the example (1), in the overlapped portion 2*b* of the work piece 2, the end edge portion needle drop points a3 to a5 are formed in the position farther from the head portion needle drop point a1 than the end edge portion needle drop points a2 and a6. With this, the bend of the work piece 2 in the overlapped portion 2*b* can be effectively suppressed, and the movement and the shaking of the interlocking element 11 can be suitably suppressed.

The three end edge portion needle drop points a3 to a5 can be positioned in the region farther from the end edge portion tip 2*aa* than the region R1. In this case, the overlapped portion 2*b* is held by the needle thread U and the bobbin thread D used in the stitch t2 formed between the needle drop points a2 to a3 and the stitch t5 formed between the needle drop points a5 to a6. With this, the bend in the work piece 2 in the overlapped portion 2*b* can be suppressed.

Each of the stitches t1 to t6 are stitches in the lock stitching. Therefore, the binding strength on the interlocking elements 11 can be easily enhanced by adjusting the needle strength tension. With this, the movement and the shaking of the interlocking elements 11 can be effectively suppressed.

Example (2) Showing Preferable Needle Drop Point in Sewing Slide Fastener

Figure 8:
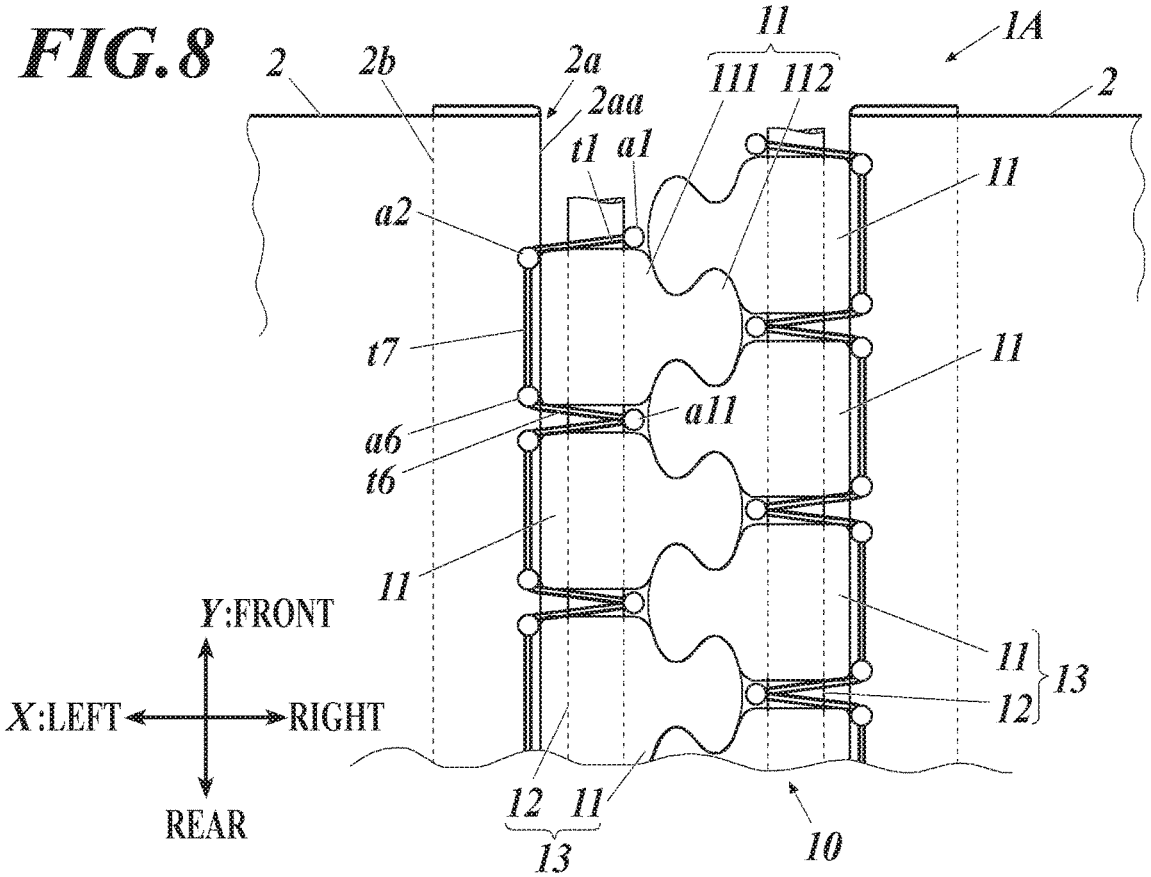
FIG. 8 is an enlarged planar view showing an example (2) of the slide fastener product.

The example (2) showing the method of sewing the slide fastener 10 and the needle drop point of the formed stitch is described based on FIG. 8. FIG. 8 is a planar view of the slide fastener product 1A in which the slide fastener 10 is sewn on the work piece 2 at a preferable needle drop point.

In the slide fastener product 1A, the above-described head portion needle drop point a1 and the above-described end edge portion needle drop points a2 and a6 are formed by sewing in order to sew the interlocking elements 11 of the interlocking element linked members 13 in the slide fastener 10. The above-described end edge portion needle drop points a3 to a5 are not formed.

The positions where the head portion needle drop point a1 and the end edge portion needle drop points a2 and a6 are formed is the same as the above-described slide fastener product 1. Therefore, the end edge portion needle drop points a2 and a6 are provided in the front end portion and the rear end portion of the region R2 in the overlapped portion 2*b* of the sewn product 2. More preferably, the end edge portion needle drop points a2 and a6 are provided within the range of the width v in the portion curved by the fold (see FIG. 2 and FIG. 5).

Using the needle drop points a1, a2, and a6, the above-described stitch t1 is formed between the needle drop points a1 to a2, the stitch t7 is formed between the needle drop points a2 to a6, and the above-described stitch t6 is formed between the needle drop points a6 to a11.

The sewing by the zigzag sewing machine 100 is performed by the following process. The end edge portion 2*a* of the work piece 2 and the string portion 12 of one interlocking element linked member 13 are aligned along the Y-axis direction and placed close to each other. The above are fed forward while the sewing needle swings along the X-axis direction. In order from the front side interlocking element 11, the needle is entered in the order of the needle drop points a1, a2, and a6 for each interlocking element 11, and the stitches t1, t7, and t6 of the locked stitching are formed in order.

In this case also, the stitch t1 and the stitch t6 are formed to pass along the sides 116 and 117 on both sides of the leg portion 111 in the Y-axis direction in the interlocking element 11 as the fixed target.

With this, since the needle thread U and the bobbin thread D hold the interlocking element 11 so as to enwrap the interlocking element 11 from the sides 116 and 117, the interlocking element 11 moving along the Y-axis direction, the head portion 112 shaking along the Y-axis direction, and the head portion 112 shaking around the Y-axis direction can be suppressed. Therefore, in the slide fastener product 1A, the linking or the separating by the slider 14 can be performed smoothly.

Example (3) Showing Preferable Needle Drop Point in Sewing Slide Fastener

Figure 9:
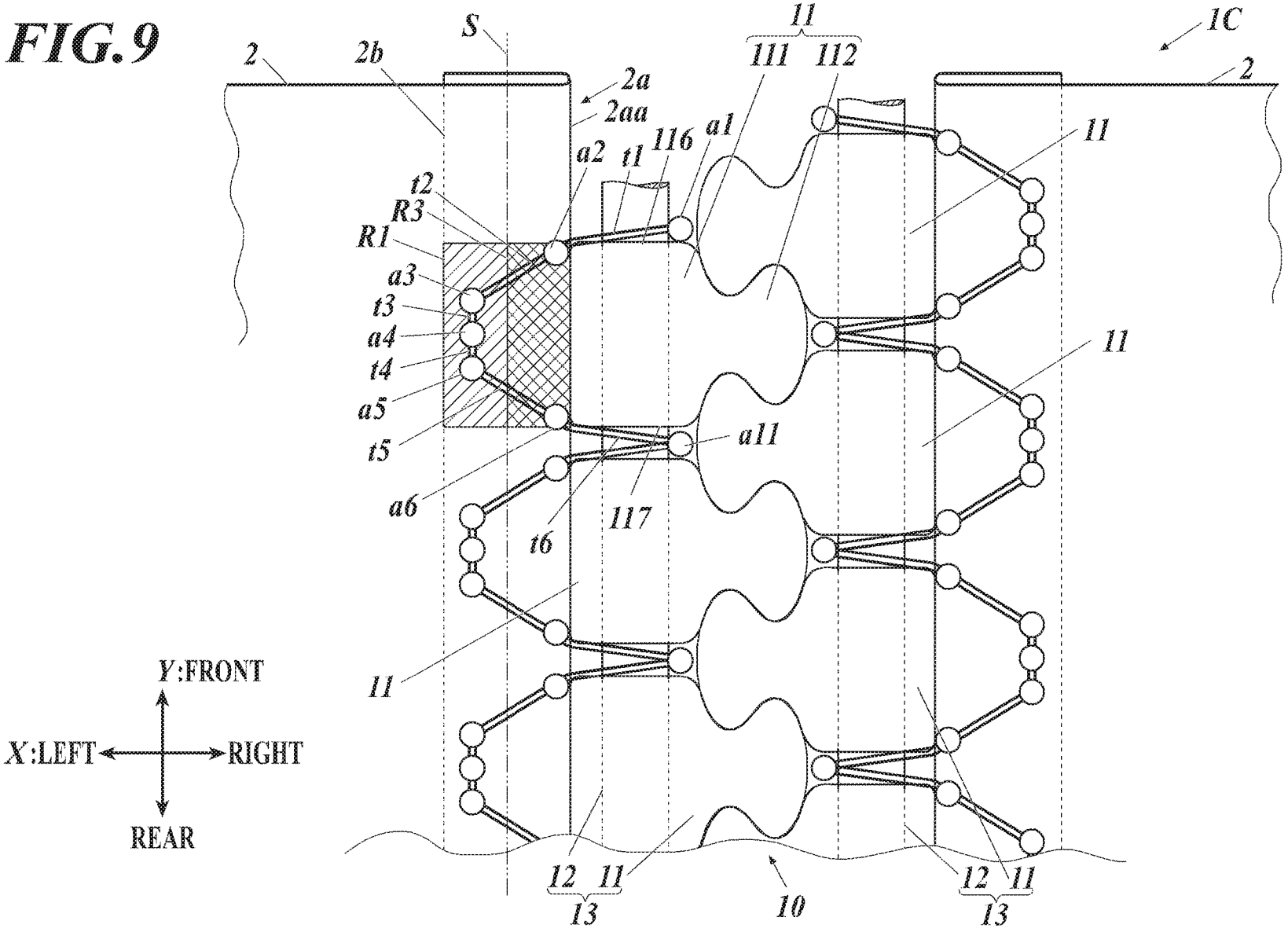
FIG. 9 is an enlarged planar view showing an example (3) of the slide fastener product.

The example (3) showing the sewing method of the slide fastener 10 and the needle drop point of the formed stitch is described based on FIG. 9. FIG. 9 is a planar view showing the slide fastener product 1C in which the slide fastener 10 is sewn to the work piece 2 at the preferable needle drop point.

In the slide fastener product 1C, the above-described head portion needle drop point a1 and the above-described end edge portion needle drop points a2 to a6 are formed by sewing in order to sew the interlocking elements 11 of the interlocking element linked member 13 of the slide fastener 10. Preferably, end edge portion needle drop points a3 to a5 are formed but these are not necessary.

The position where the head portion needle drop point a1 is formed is the same as the above-described slide fastener product 1.

The positions where the end edge portion needle drop points a2 and a6 are formed are related to the range where the above-described slider 14 passes on the work piece 2. The line S shown in FIG. 9 shows a track where the end on the most outer side of the slider 14 in the X-axis direction passes when the slider 14 moves to link or separate the pair of interlocking element linked members 13. That is, the range on the interlocking element linked member 13 side of the line S is where the slider 14 passes on the work piece 2. The end edge portion needle drop points a2 and a6 are provided in the front end portion and the rear end portion in the region R3 which is within the range where the slider 14 passes on the work piece 2 and which is on the inner side of the width of the leg portion 111 in the Y-axis direction in the interlocking element 11.

As described above, preferably, the end edge portion needle drop points a3 to a5 are provided in the region R1 but may be provided farther from the interlocking element linked member 13 than the overlapped portion 2*b* of the work piece 2.

Other Examples of Needle Drop Points when Sewing Slide Fastener

Figure 10:
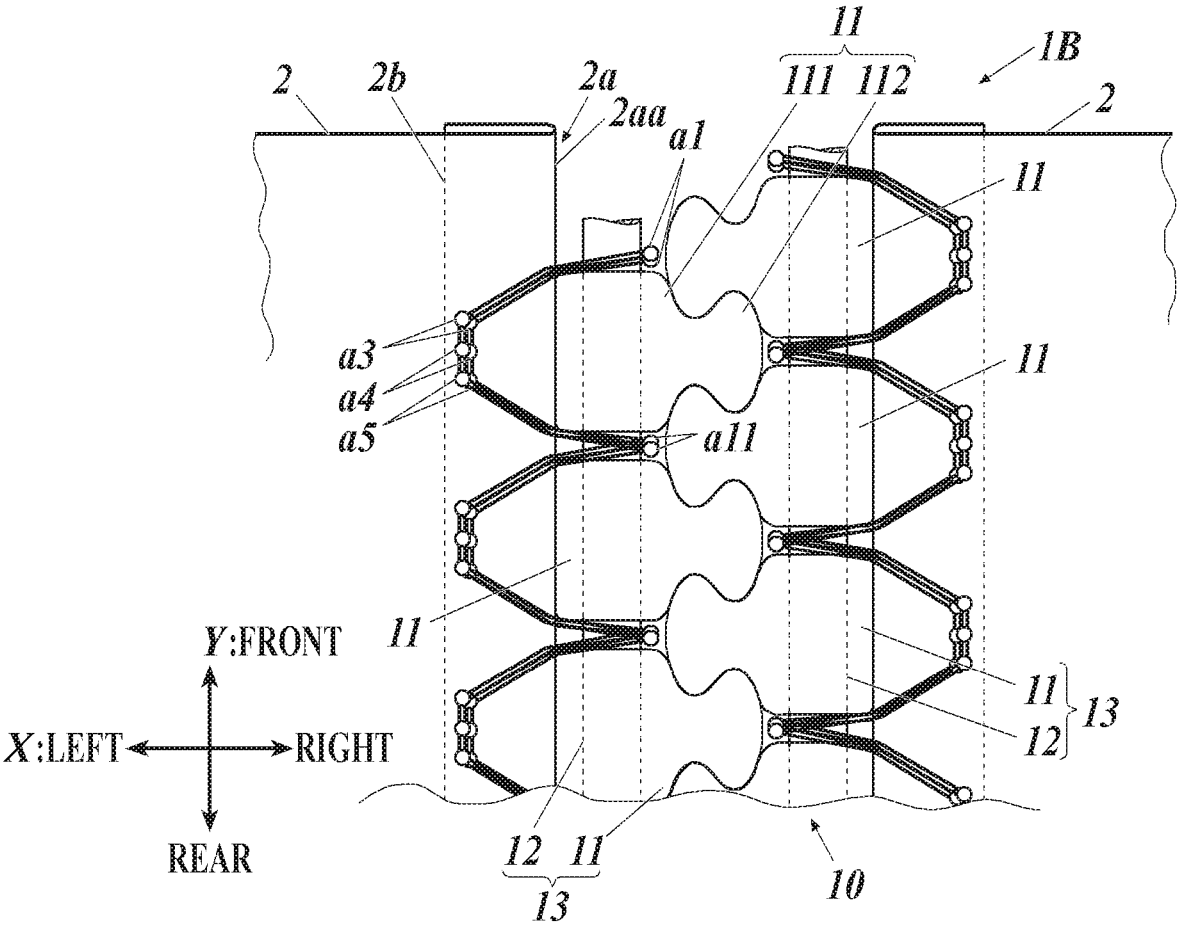
FIG. 10 is an enlarged planar view of another example of the slide fastener product.

Other examples of the sewing method of the slide fastener 10 and needle drop points of the formed stiches are described with reference to FIG. 10. FIG. 10 is a planar view showing the slide fastener product 1B in which the slide fastener 10 is sewn to the work piece 2 based on the other examples of the needle drop points.

In the slide fastener product 1B, the above-described head portion needle drop point a1 and the above-described end edge portion needle drop points a3 to a5 are formed double by sewing in order to sew the interlocking elements 11 of the interlocking element linked member 13 in the slide fastener 10. The above-described end edge portion needle drop points a2 and a6 are not formed.

The positions where the head portion needle drop point a1 and the end edge portion needle drop points a3 to a5 are formed are the same as the above-described slide fastener product 1.

According to the above-described needle drop points a1 and a3 to a5, the stitches the same as the comparative example (2) shown in FIG. 7 are formed double.

Sewing with the zigzag sewing machine 100 is performed as follows. The end edge portion 2*a* of the work piece 2 and the string portion 12 of one interlocking element linked member 13 are aligned along the Y-axis direction close to each other. The above is fed forward while the sewing needle swings along the X-axis direction. From the front side interlocking element 11 in order, the needle is entered in the needle drop point a1 and from the needle drop point a3 to the needle drop point a5 in order for each interlocking element 11. The stitches of the lock stitching are formed in order.

Then, when the forming of the stitches throughout the entire length of the interlocking element linked member 13 ends, the process is repeated again, and the stitches are formed throughout the entire interlocking element linked member 13 to form the double stitches.

Since the stitches by the end edge portion needle drop points a2 and a6 are not formed, if the sewing is performed single, as shown in the comparative example (2) in FIG. 7, the binding strength on the interlocking element 11 becomes weak, and the movement and the shaking cannot be suppressed sufficiently. According to the example shown in FIG. 10, the sewing is performed double, and the binding strength on the interlocking element 11 is compensated. With this, the movement and the shaking of the interlocking element 11 can be sufficiently suppressed.

Alternatively, the sewing can be performed double while forming stitches using the end edge portion needle drop points a2 and a6, and the interlocking element 11 can be bound more strongly.

Moreover, by repeating the forming of the stitches, the stitches can be formed triple or more.

[Zigzag Sewing Machine]

The zigzag sewing machine 100 suitable as the sewing machine for sewing the pair of interlocking linked elements 13 to the work piece 2 in the slide fastener product 1 is described with reference to the drawings.

Figure 11:
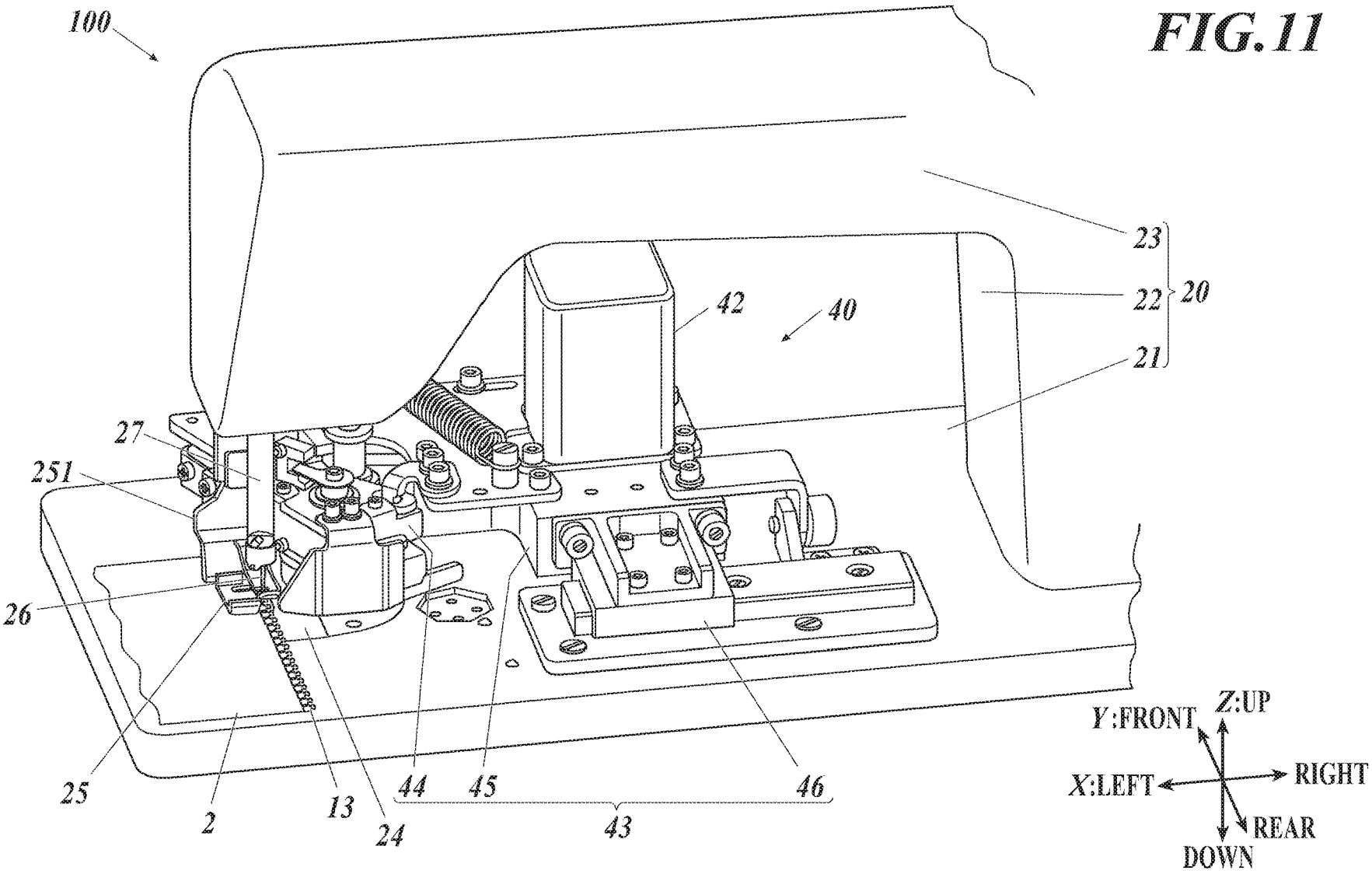
FIG. 11 is a perspective view of a zigzag sewing machine according to an embodiment of the invention.

FIG. 11 is a perspective view of the zigzag sewing machine 100.

The zigzag sewing machine 100 includes a sewing machine frame 20 including a sewing machine head 21, a cloth presser foot 25 which presses from above the work piece 2 on the upper surface of the throat plate 24 provided in the sewing machine head 21, a needle vertical movement mechanism which performs needle drop by vertically moving the sewing needle 26 on the work piece 2 on the throat plate 24 while shaking the sewing needle 26 horizontally, a cloth feeding mechanism which uses a feed dog from a lower side of the throat plate 24 to feed the sewn product 2 in a predetermined cloth feeding direction, a hook mechanism which twines the bobbin thread D to the needle thread U of the sewing needle 26, and a fastener conveying mechanism 40 which conveys the interlocking element linked member 13 of the slide fastener 10.

The configurations other than the fastener conveying mechanism 40 are the same as the well-known configurations provided in the typical zigzag sewing machine. Therefore, the illustration is omitted and a simple description is provided.

[Sewing Machine Frame]

The sewing machine frame 20 includes a sewing machine head 21 positioned in a lower portion of the entire zigzag sewing machine 100, a standing body 22 provided standing upward on one end of the sewing machine head 21, and a sewing machine arm 23 which extends from the upper end portion of the standing body 22 in a predetermined direction.

According to the description below, the longitudinal direction in the sewing machine head 21 and the sewing machine arm 23 of the zigzag sewing machine 100 are to be in the X-axis direction. The throat plate 24 side of the sewing machine head 21 is to be "left" and the standing body 22 side is to be "right".

The zigzag sewing machine 100 conveys the work piece 2 and the interlocking element linked member 13 on the throat plate 24 in the direction orthogonal to the X-axis direction. Such conveying direction is to be the Y-axis direction and the downstream side of the conveying direction is to be "front", and the upstream side of the conveying direction is to be "rear".

The direction orthogonal to the X-axis direction and the Y-axis direction is to be the Z-axis direction, and one side is "up" and the other side is "down".

The X-axis direction to Z-axis direction defined as described above for the slide fastener product 1 matches with the state in which the work piece 2 and the interlocking element linked member 13 of the slide fastener product 1 are set in the zigzag sewing machine 100 when the sewing is performed.

[Needle Vertical Movement Mechanism]

The needle vertical movement mechanism includes a needle bar 27 which holds the sewing needle 26, a sewing machine motor which is to be a driving source of the sewing, an arm shaft which is driven to rotate by the sewing machine motor, a crank mechanism which converts the rotating motion of the arm shaft to the reciprocating motion in the vertical direction applied to the needle bar 27, a needle bar supporting base which supports the needle bar so as to be able to move vertically, and a needle swinging motor which freely moves the needle bar supporting base along the X-axis direction.

The needle vertical mechanism moves the sewing needle 26 vertically at the sewing speed according to the number of rotations of the sewing machine motor. The needle vertical movement mechanism is able to freely adjust the needle drop position of the sewing needle 26 along the X-axis direction orthogonal to the conveying direction of the interlocking element linked member 13.

[Hook Mechanism]

The hook mechanism includes a hook provided on the lower side of the throat plate 24 and a transmission mechanism which applies rotation force to the hook from the sewing machine motor.

The hook stores the bobbin wrapped with the bobbin thread D and stores the blade point in the outer circumference. The blade point catches the loop of the sewing thread passing through the sewing needle 26, passes the bobbin through the loop of the sewing thread to twine the bobbin thread D to the needle thread U, and forms a knot.

The vertical hook or the horizontal hook can be used as the hook, and the hook which makes a half rotation or a full rotation can be used.

[Cloth Feeding Mechanism]

The cloth feeding mechanism includes a feed dog which appears from an opening 241 (see FIG. 12) of the throat plate 24, and a feeding transmission mechanism which combines the reciprocating movement in the Z-axis direction and the reciprocating movement in the Y-axis direction and transmits the movement to the feed dog.

The feed dog includes saw-tooth shaped teeth which appear from the opening 241 formed in the throat plate 24. The feeding transmission mechanism obtains power from the sewing machine motor and converts the reciprocating movement along the Z-axis direction and the reciprocating movement along the Y-axis direction. The power is transmitted to the feed dog. With this, the feed dog moves in an oval movement combining the vertical and horizontal reciprocating movements in the Y-Z plane. When moving in the upper portion of the oval, the tips of the teeth project upward from the opening 241 and move forward. Therefore, the work piece 2 can be fed forward.

The cloth feeding mechanism is able to freely adjust the feeding amount of the work piece 2 in the Y-axis direction for each stitch.

Alternatively, a feeding adjustment motor can be provided in the cloth feeding mechanism to freely adjust the feeding amount of the cloth, and the fed amount can be

[Throat Plate]

Figure 12:
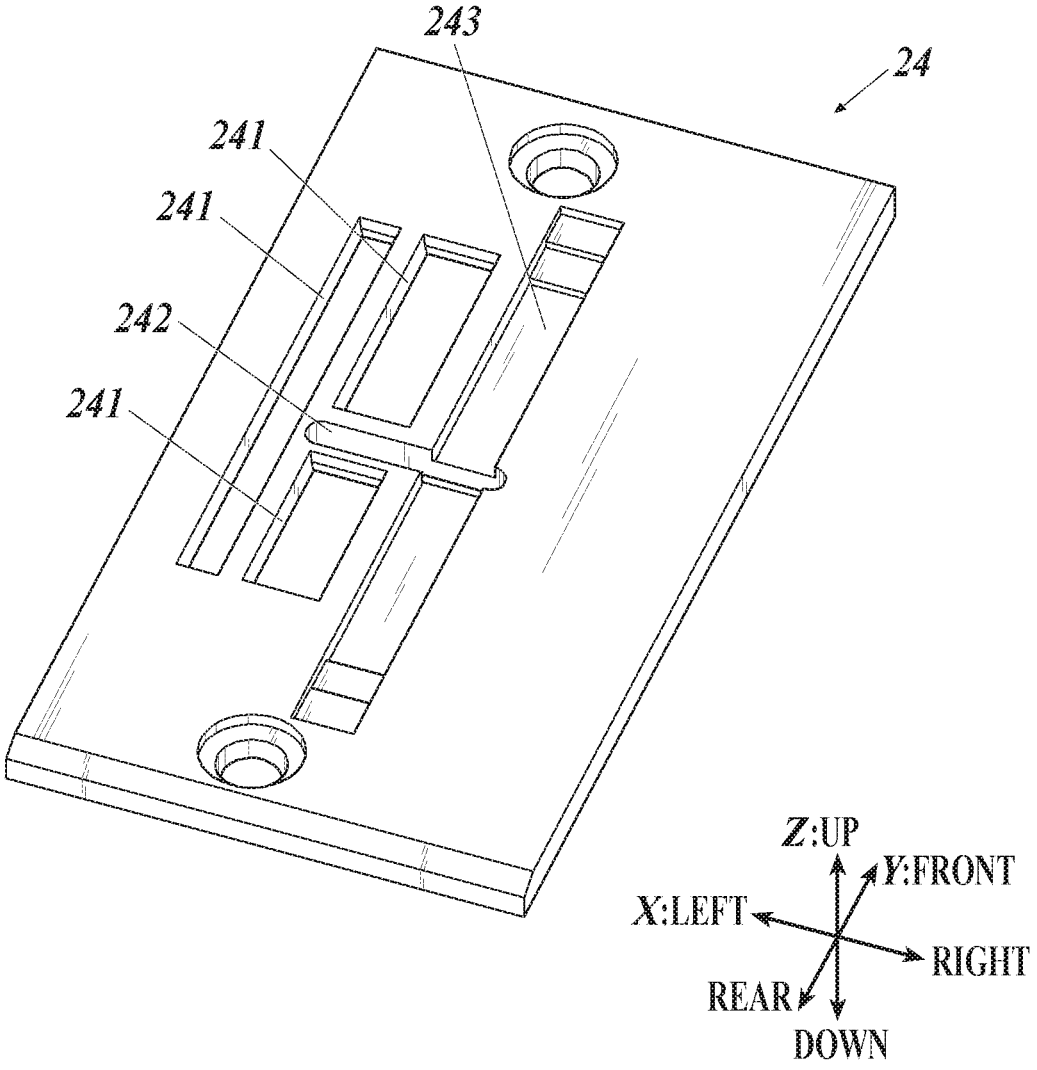
FIG. 12 is a perspective view of a throat plate.

FIG. 12 is a perspective view of the throat plate 24. The throat plate 24 is provided in the needle drop position of the sewing needle 26 on the upper surface of the sewing machine head 21. The upper surface of the throat plate 24 is flat and the throat plate 24 is mounted so that the upper surface of the throat plate 24 is to be on the same plane as the upper surface of the sewing machine head 21.

The throat plate 24 is a rectangular flat plate and work piece 2 is conveyed along the Y-axis direction along the left half side of the upper surface.

In the center of the throat plate 24, the needle eyelet 242 in a slit shape is formed penetrating along the X-axis direction. Three openings 241 are formed penetrating the front, rear, and left side of the needle eyelet 242, and the above-described feed dog appears from the openings. The needle eyelet 242 is formed in a slit along the X-axis direction so as to be able to correspond with the needle drop by the needle swinging along the X-axis direction.

A feeding groove 243 for the interlocking element linked member 13 along the Y-axis direction is formed in the center of the upper surface of the throat plate 24 in the X-axis direction. Such feeding groove 243 is formed so that the width in the X-axis direction is substantially the same as or slightly wider than the length of the interlocking element 11 in the X-axis direction. The interlocking element linked member 13 is placed in the feeding groove 243 so as to be able to guide the interlocking element linked member 13 along the Y-axis direction the same as the conveying direction of the work piece 2.

The depth of the feeding groove 243 is shallower than half the length of the interlocking element 11 in the Z-axis direction and the work piece 2 on the throat plate 24 is placed in the center of the Z-axis direction of the interlocking element 11 with relation to the interlocking element 11. The front end portion and the rear end portion of the feeding groove 243 are formed so that the inner base of the groove is in a slope shape.

The above-described needle eyelet 242 is formed so as to cross the center of the feeding groove 243 in the Y-axis direction.

The throat plate 24 functions as the fastener guide to guide the interlocking element linked member 13 in the same Y-axis direction as the feeding direction of the work piece 2 using the feeding grove 243.

[Cloth Presser Foot]

Figure 13:
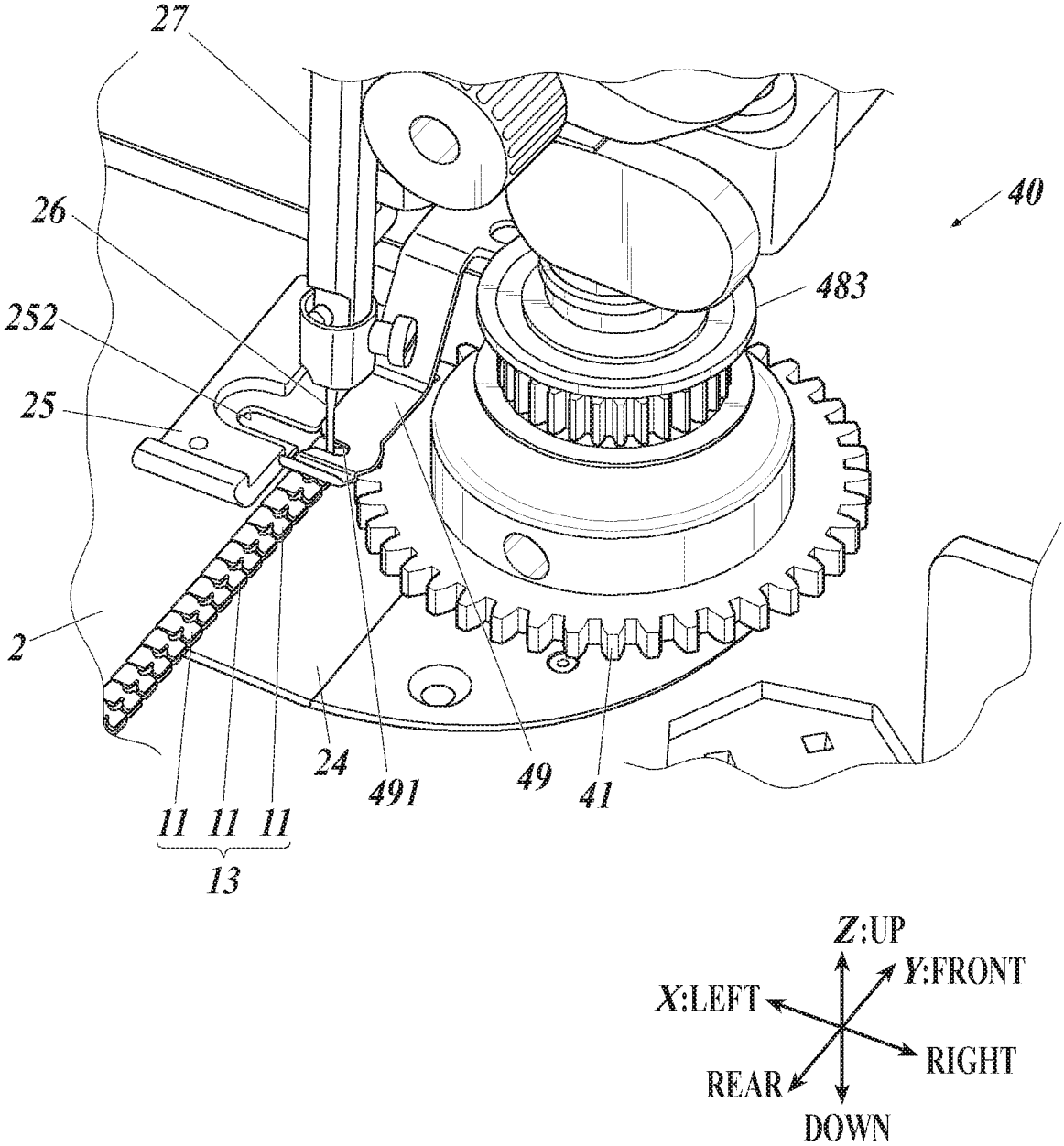
FIG. 13 is a perspective view showing surroundings of a needle drop position.

FIG. 13 is a perspective view around the needle drop position. The cloth presser foot 25 is supported pressed downward on the throat plate 24 by the supporting bracket 251 provided in the sewing machine head 21.

Such cloth presser foot 25 is a rectangular plate shape along the Y-axis direction, and a notch 252 in a half oval shape to avoid the falling sewing needle 26 is formed in the end edge portion on the right side of the cloth presser foot 25. Such notch 252 overlaps with the left half of the needle eyelet 242 of the throat plate 24 viewed from above.

The cloth presser foot 25 applies presser foot pressure on the work piece 2 conveyed on the throat plate 24 with the pressure from the supporting bracket 251.

[Fastener Conveying Mechanism]

Figure 14:
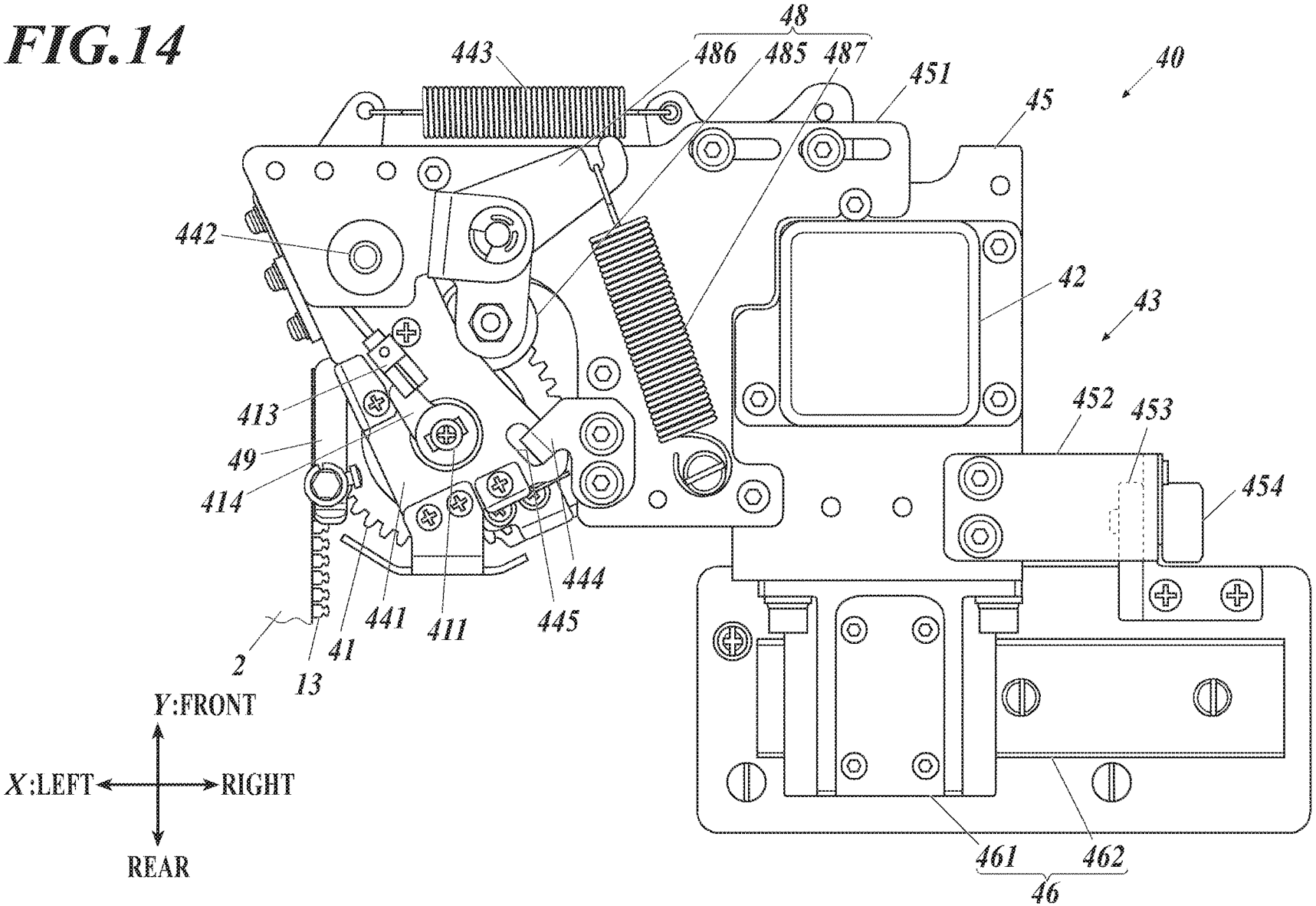
FIG. 14 is a planar view showing a fastener conveying mechanism.
Figure 15:
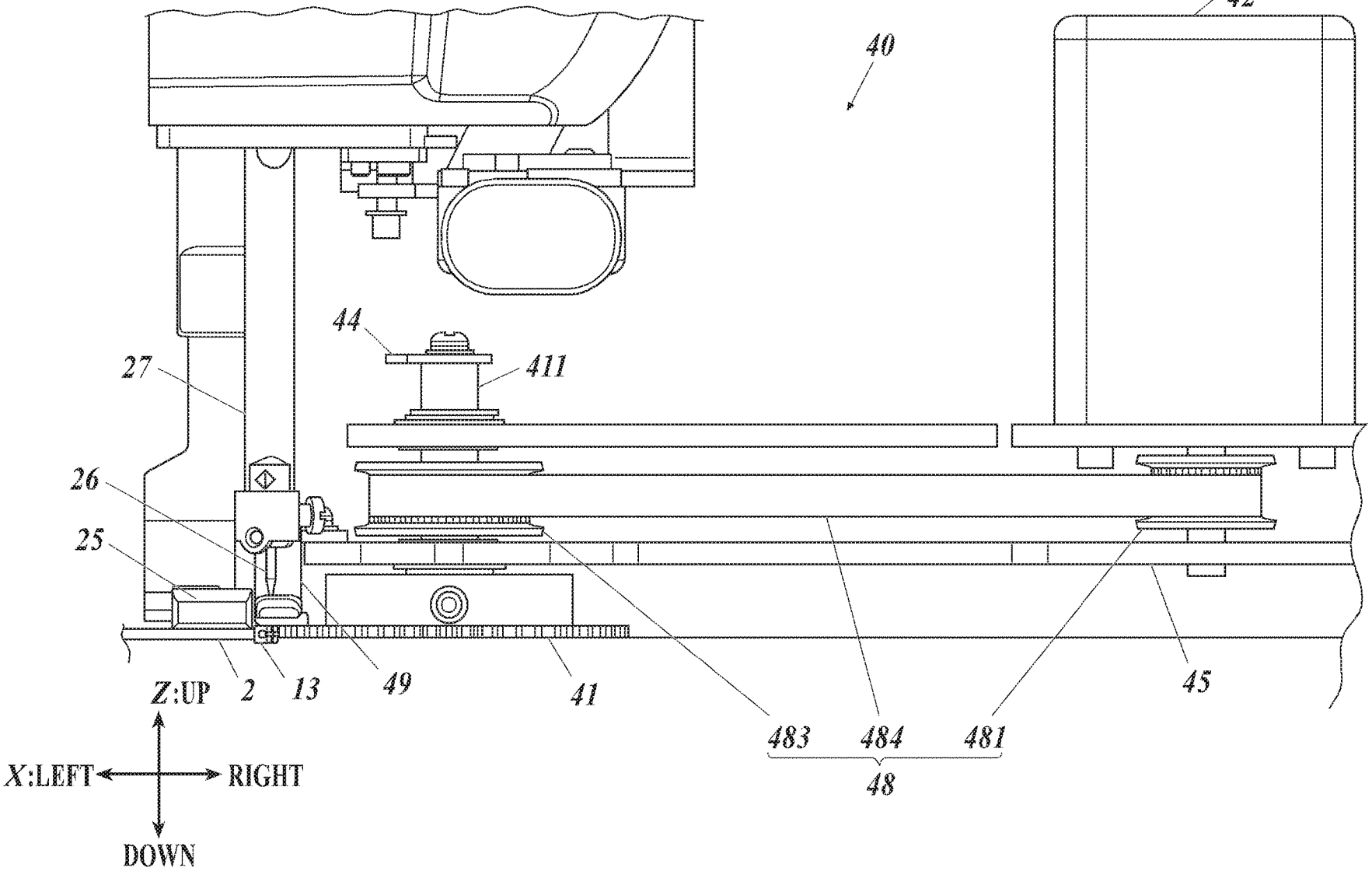
FIG. 15 is a rear view showing the fastener conveying mechanism.

FIG. 14 is a planar view showing the fastener conveying mechanism 40. FIG. 15 is a rear view.

As shown in the drawings, the fastener conveying mechanism 40 includes a conveying gear 41 provided with teeth which interlock with the interlocking element 11 in the interlocking element linked member 13, a conveying motor 42 which applies a rotation operation on the conveying gear 41, a supporting mechanism 43 which supports the conveying gear 41, a transmission mechanism 48 which transmits rotation force to the conveying gear 41 from the conveying motor 42, and a fastener presser foot 49 which prevents the interlocking element linked member 13 conveyed by the conveying gear 41 from floating upward.

Figure 16:
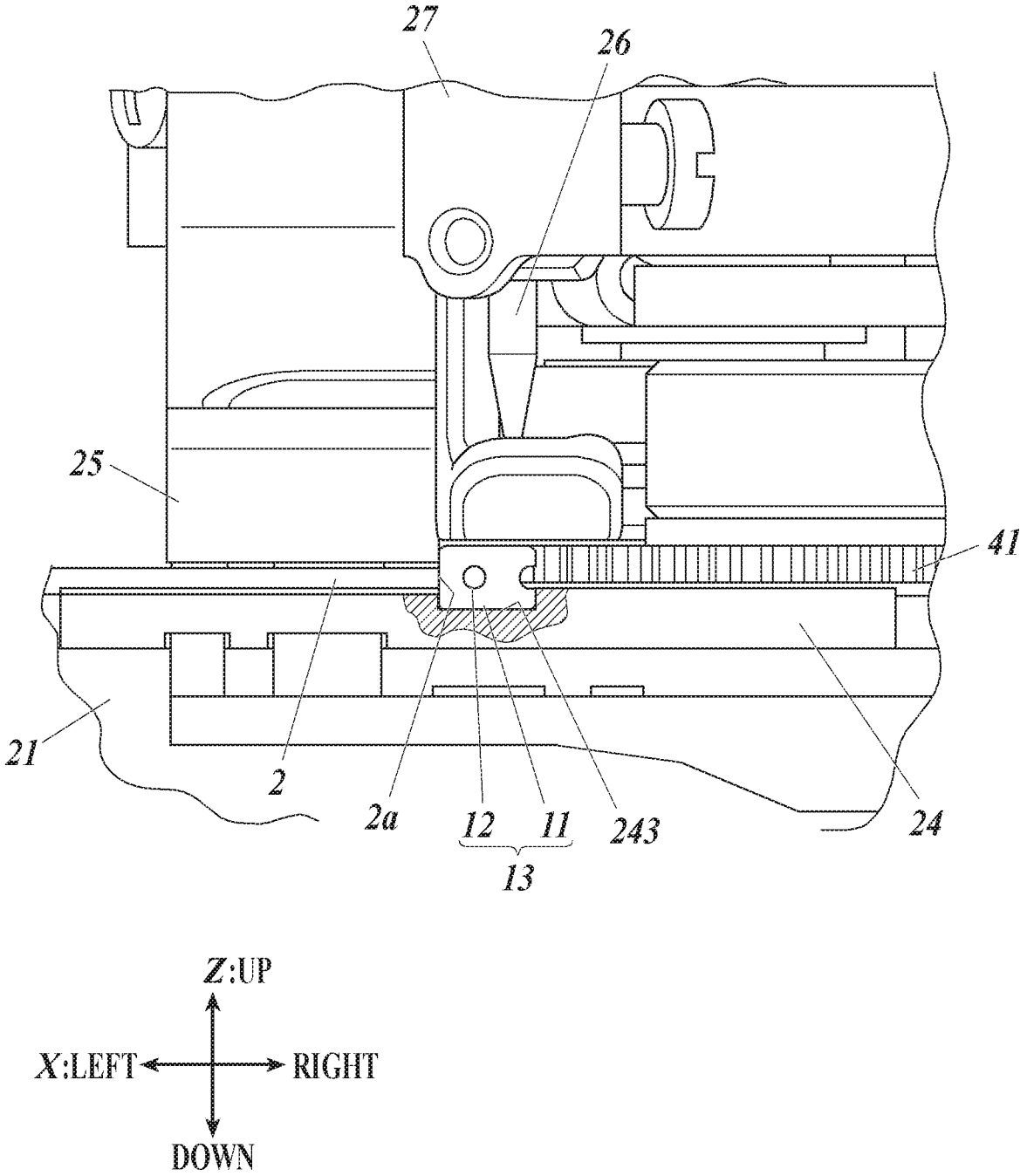
FIG. 16 is a rear view showing surroundings of the needle drop position.

FIG. 16 is a rear view around the needle drop position.

As shown in FIG. 13 and FIG. 16, the conveying gear 41 is a spur gear provided with teeth on the outer circumference so as to interlock with the head portion 112 of one or a plurality of interlocking elements 11 in the interlocking element linked member 13 along the Y-axis direction. The conveying gear 41 is supported by the supporting mechanism 43 so as to be able to rotate around the Z-axis.

The pitch width of the conveying gear 41 matches with the pitch of the interlocking elements 11 of the interlocking element linked member 13, and the tooth width of the conveying gear 41 is substantially the same as the width subtracting the depth of the feeding groove 243 on the throat plate 24 from the length of the interlocking element 11 in the Z-axis direction. Therefore, the upper surface of the interlocking element 11 of the interlocking element linked member 13 conveyed in the feeding groove 243 of the throat plate 24 is at the same height as the upper surface of the conveying gear 41.

The conveying gear 41 is positioned to the right of the needle drop position and is positioned to interlock from the right side with the interlocking element linked member 13 in which the head portions 112 of the interlocking elements 11 face the right.

Therefore, when the rotation is applied to the conveying gear 41, the interlocking element linked member 13 can be conveyed along the Y-axis direction.

As shown in FIG. 13 and FIG. 16, the fastener presser foot 49 is supported by a base plate 45 of the supporting mechanism 43 in the front of the needle drop position and extends toward the rear to the needle drop position.

The lower surface of the extending end portion of the fastener presser foot 49 is at a height in contact with or close to the upper surface of the interlocking element 11 of the interlocking element linked member 13 in the feeding groove 243 of the throat plate 24 in the needle drop position.

This prevents the interlocking element linked member 13 meshed with the conveying gear 41 from floating upward from the conveying gear 41 in the feeding groove 243.

A notch 491 in the half oval shape is formed in the fastener presser foot 49 in the end edge portion on the left side of the extending end portion in order to avoid the falling sewing needle 26. Such notch 491 overlaps with the right half of the needle eyelet 242 of the sewing needle 24 viewed from above.

Figure 17:
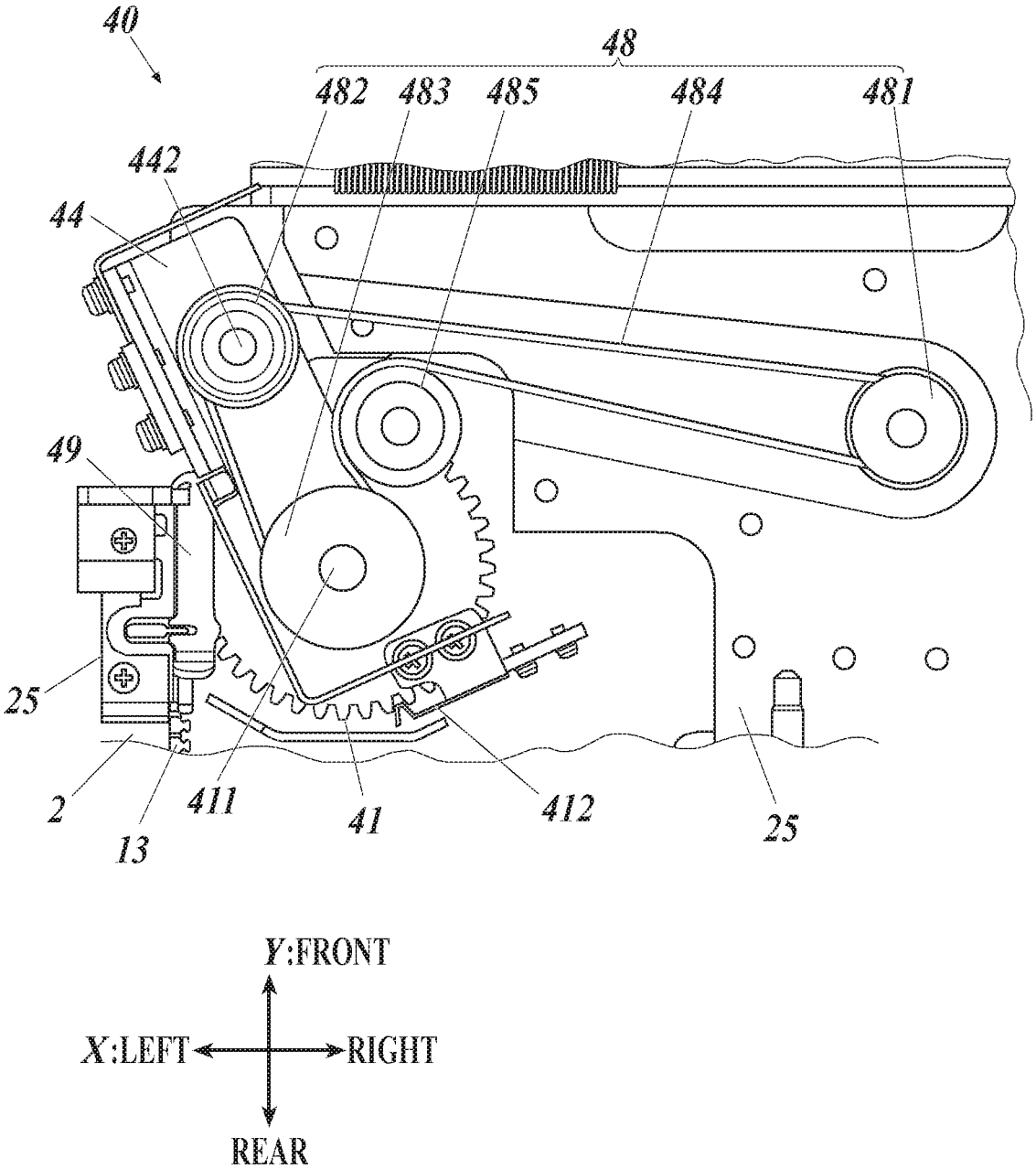
FIG. 17 is a planar view showing an upper cover of a base plate of a supporting mechanism and an upper cover of a supporting arm taken off.

FIG. 17 is a planar view showing a state in which an upper cover 451 of the base plate 45 of the supporting mechanism 43 and an upper cover 441 of the supporting arm 44 are detached.

As shown in FIG. 14 and FIG. 17, the supporting mechanism 43 includes a supporting arm 44 which supports the conveying gear 41, a base plate 45 which supports the supporting arm 44, and a sliding guide 46 supports the base plate 45 so as to be able to slide along the X-axis direction.

The base plate 45 is a flat plate along the X-Y plane and is placed on the sewing machine head 21 with the sliding guide 46 in between to be positioned between the needle drop position and the standing body 22.

The base plate 45 supports the conveying gear 41 through the supporting arm 44 and also supports the conveying motor 42 and the transmission mechanism 48.

The base plate 45 includes an upper cover 451 in the upper portion of the base plate 45, and a portion of the transmission mechanism 48 supported by the base plate 45 is covered.

The slide guide 46 includes a movable block 461 fixed linked to the base plate 45 and a slide rail 462 attached to the sewing machine head 21 along the X-axis direction so as to be able to slide the base plate 45 along the X-axis direction through the movement of the movable block 461.

A regulating bracket 452 is provided in the right end of the base plate 45 to define the sliding of the base plate 45 along the X-axis direction.

The regulating bracket 452 extends to the right, and the extending end portion supports a linking screw 454 to be rotatable. A fixing plate 453 in which a screw hole is formed to be able to screw in the linking screw 454 is provided in the sewing machine head 21.

The left surface of the extending end portion of the regulating bracket 452 and the right surface of the fixing plate 453 are linked to each other in a state in contact with each other by a linking screw 454. With this, it is possible to fix the base plate 45 to the defined position when sewing is performed. If the linking screw 454 is loosened and the regulating bracket 452 is separated to the right from the fixing plate 453, the base plate 45 can be moved to the right from the defined position. The right end portion of the base plate 45 comes into contact with the left surface of the fixing plate 453 when the base plate 45 is moved to the right. Such contact position is the movable limit of the right side of the base plate 45.

As described above, the base plate 45 supports the conveying gear 41 through the supporting arm 44, and the conveying gear 41 comes into contact with the interlocking element 11 of the conveyed interlocking element linked member 13 from the right and conveys the above.

The defined position of the above-described base plate 45 during sewing is the position in which the tips of the teeth of the conveying gear 41 suitably mesh with the head portions 112 of the interlocking elements 11 and which is suitable for conveying by rotation when the interlocking element linked member 13 is conveyed.

If the linking screw 454 is loosened and the regulating bracket 452 is separated from the fixing plate 453, the base plate 45 moves to the right, the meshed state to the head portion 112 of the interlocking element 11 in the interlocking element linked member 13 is released, and the tips of the teeth of the conveying gear 41 are separated to the right.

With this, for example, the maintenance of the fastener conveying mechanism 40 and the operation of detaching the interlocking element linked member 13 from the throat plate 24 can be easily performed.

As shown in FIG. 14 and FIG. 17, the supporting arm 44 supports the supporting shaft 442 along the Z-axis direction to be rotatable in the left end of the base plate 45. The rotating end portion of the supporting arm 44 points diagonally to the rear right.

The rotating end portion of the supporting arm 44 supports the conveying gear 41 to be rotatable through the supporting shaft 411.

The rotating end portion of the supporting arm 44 includes a latch plate 412 in a plate spring shape so as to fit in a tooth groove of the outer circumference of the conveying gear 41. The latch plate 412 includes a projection which presses the conveying gear 41 with contact at a certain spring pressure. The latch plate 412 prevents backlash of the conveying gear 41.

An upper cover 441 is attached and fixed to the upper portion of the supporting arm 44, and a one end portion of a tension spring 443 is linked to a front end portion of the upper cover 441. The other end portion of the tension spring 443 is linked to the base plate 45, and bias force is applied in the direction to make the conveying gear 41 supported by the supporting arm 44 come closer to the interlocking element linked member 13 side.

A regulating opening 445 is formed in the rotating end portion side of the upper cover 441 to loosely insert the extending end portion of the rotating angle regulating plate 444 supported fixed by the base plate 45.

With this, the rotatable angle range of the supporting arm 44 on the base plate 45 is limited so that the conveying gear 41 only moves from the left limit position to the right limit position.

According to the rotatable angle range, the conveying gear 41 is able to move from the position where the teeth of the conveying gear 41 suitably interlocks at a certain pressure with the head portions 112 of the interlocking elements 11 in the interlocking element linked member 13 positioned in the feeding groove 243 to the position where the conveying gear 41 is completely separated from the interlocked state with the head portions 112 of the interlocking elements 11.

As described above, since the supporting arm 44 is able to rotate within a predetermined angle range, for example, the supporting arm 44 can be rotated to the right manually while holding the base plate 45 in the defined position for sewing, and after the sewing is finished, the interlocked state between the conveying gear 41 and the interlocking elements 11 of the interlocking element linked member 13 is released so as to be able to detach the interlocking element linked member 13 from the state on the throat plate 24.

An origin sensor 413 of the conveying gear 41 and its detecting plate 414 are provided on the upper surface of the upper cover 441 of the supporting arm 44.

The detecting plate 414 is mounted fixed to the upper end portion of the supporting shaft 411 in the conveying gear 41. The detecting plate 414 extends in a radius direction with the supporting shaft 411 as the center.

The origin sensor 413 is a magnetic proximity sensor. The origin sensor 413 is provided in the upper surface of the upper cover 441 within the range where the detecting plate 414 rotates around the supporting shaft 411. The origin position of the conveying gear 41 is detected when the detecting plate 414 comes near the origin sensor 413.

The conveying motor 42 is a stepping motor and the feeding amount of the interlocking element linked member 13 by the conveying gear 41 can be freely controlled through the transmission mechanism 48.

As shown in FIG. 14 and FIG. 15, the conveying motor 42 is attached on the base plate 45 in a state with the output shaft pointing downward.

As shown in FIG. 14 to FIG. 17, the transmission mechanism 48 includes a main driving pulley 481 which is mounted fixed to the output shaft of the conveying motor 42, an intermediate pulley 482 which is supported to be rotatable with relation to the supporting shaft 442 of the supporting arm 44, a driven pulley 483 which is mounted fixed to the supporting shaft 411 of the conveying gear 41, a timing belt 484 which hangs from the main pulley 481 through the intermediate pulley 482 and to the driven pulley 483, and a tension roller 485 which applies tension to the timing belt 484.

The intermediate pulley 482 is able to rotate with relation to the supporting shaft 442 of the supporting arm 44 and the intermediate pulley 482 is able to rotate independent from the rotation of the supporting arm 44.

The driven pulley 483 is mounted fixed to the supporting shaft 411 of the conveying gear 41, and the conveying gear 41 is also fixed to the supporting shaft 411. Therefore, the driven pulley 483 and the conveying gear 41 rotate together at the same time.

The tension roller 485 is supported by a bell crank 486 provided in the upper cover 451 of the base plate 45, and the bell crank 486 is linked to the tension spring 487 which applies tension in the direction that the tension roller 485 presses the timing belt 484 from the outer side to the inner side.

As shown in FIG. 17, the tension roller 485 presses against the timing belt 484 so that the timing belt 484 is in a substantial L shape connecting the positions of the main pulley 481, the intermediate pulley 482, and the driven pulley 483 in order.

By maintaining the timing belt 484 in such shape, even if the supporting arm 44 is rotated, the bend in the timing belt 484 can be reduced, and the difference in the angle between the output shaft angle of the conveying motor 42 and the rotating angle of the conveying gear 41 can be reduced.

Figure 18:
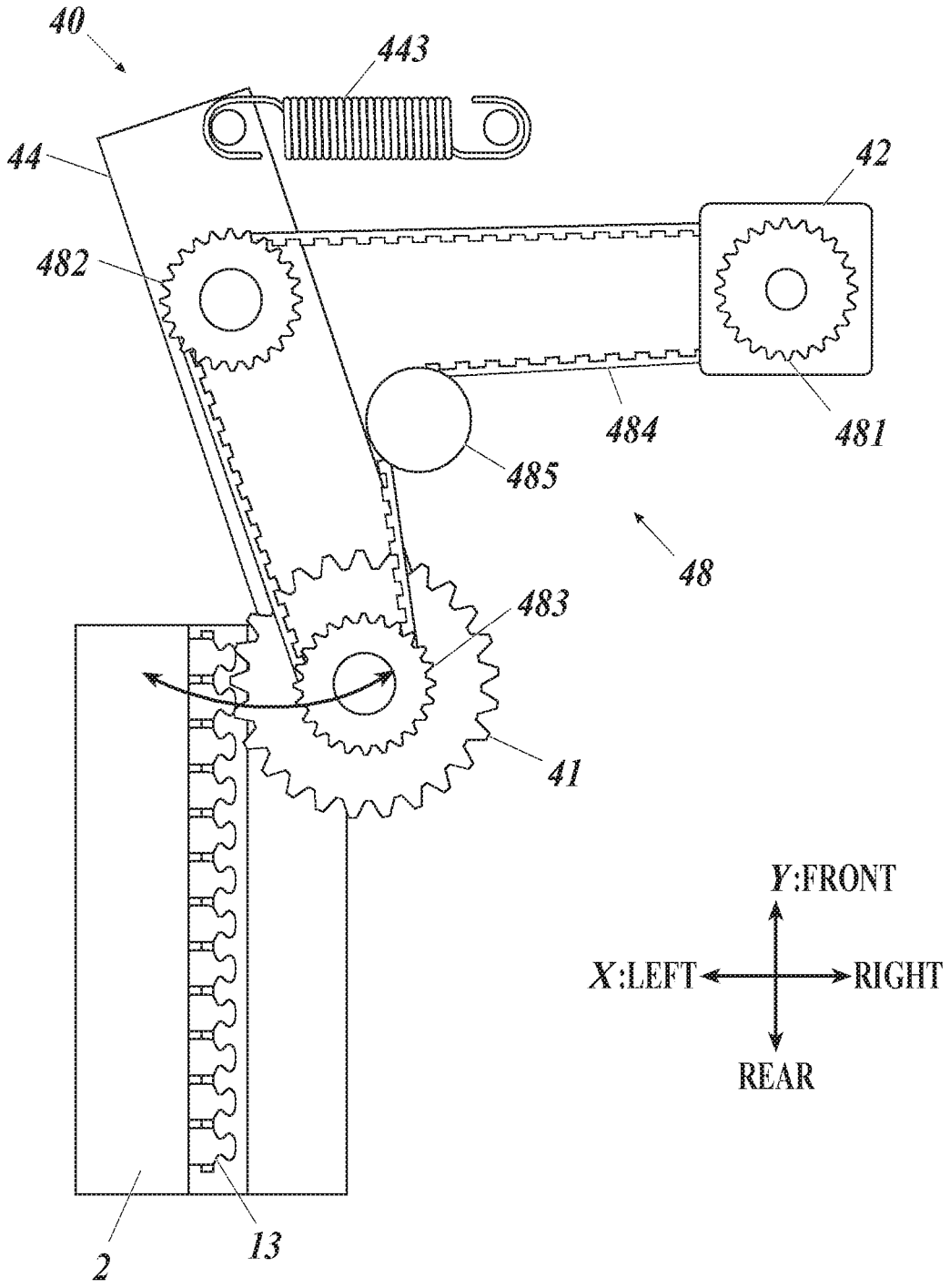
FIG. 18 is a schematic diagram showing an example applying a pulley with teeth to a transmission mechanism.

As shown in FIG. 18, all of the pulleys in the transmission mechanism 48 including the main pulley 481, the intermediate pulley 482, and the driven pulley 483 can be pulleys with teeth, and the timing belt 484 can be a belt with teeth.

[Sewing of Slide Fastener Product by Zigzag Sewing Machine]

The sewing operation by the zigzag sewing machine 100 is described with an example in which the interlocking element linked member 13 on the left side of the slide fastener 10 in the slide fastener product 1 shown in FIG. 2 is sewn to the end edge portion 2*a* of the work piece 2.

First, the origin of the conveying gear 41 of the fastener conveying mechanism 40 is searched. That is, the control apparatus included in the zigzag sewing machine 100 drives the conveying motor 42 to rotate the conveying gear 41, and detects the detecting plate 414 with the origin sensor 413. Then, after the detecting plate 414 is detected, the conveying motor 42 is stopped at the origin position of the conveying gear 41.

The user of the sewing machine turns the linking screw 454 and releases the linked state between the regulating bracket 452 and the fixing plate 453, the user moves the base plate 45 to the right and evacuates the conveying gear 41 to the right of the needle drop position.

Next, the user of the sewing machine sets the interlocking element linked member 13 in the feeding groove 243 of the throat plate 24 so that the first interlocking element 11 is positioned in the needle drop position, and the work piece 2 is set under the cloth presser foot 25 so that the end edge portion 2*a* is placed along the left side of the interlocking element linked member 13.

Then, the base plate 45 is moved to the left defined position for sewing, the linking screw 454 is turned, and the regulating bracket 452 and the fixing plate 453 are linked again.

Then, the driving of the sewing machine motor starts. During the sewing, the needle swinging motor and the conveying motor 42 are controlled for each needle drop so that the needle drop in the needle drop points a1 to a6 as shown in FIG. 2 is repeated. The sewing machine motor is provided with an encoder and the timing to control the needle swinging motor and the conveying motor 42 is detected for each stitch.

Specifically, when the sewing starts by the needle drop in the needle drop point a1, at a suitable timing detected by the encoder of the sewing machine motor, before the next needle drop, the needle swinging motor swings the needle to the left to the needle drop point a2, and the conveying motor 42 feeds the interlocking element linked member 13 forward to move the interlocking element linked member 13 forward in an amount to reach the needle drop point a2.

The positioning from the needle drop point a2 to the needle drop point a3, the positioning from the needle drop point a3 to the needle drop point a4, the positioning from the needle drop point a4 to the needle drop point a5, the positioning from the needle drop point a5 to the needle drop point a6, and the positioning from the needle drop point a6 to the needle drop point a1 in the next interlocking element 11 are all similarly performed.

The specific numeric value data for the amount that the needle swinging motor swings the needle to perform the needle drop to the needle drop points a1 to a6, and for the amount moved forward by the conveying motor 42 is stored in advance in the data memory provided in the control apparatus of the zigzag sewing machine 100. Therefore, the numeric value data is read for each needle drop.

When all of the interlocking elements 11 in the interlocking element linked member 13 are sewn to the work piece 2 by repeating the needle drop in the drop points a1 to a6, the operation of the sewing machine motor, the needle swinging motor, and the conveying motor 42 stops.

Then, the user of the sewing machine turns the linking screw 454 and releases the linked state between the regulating bracket 452 and the fixing plate 453. The user moves the base plate 45 to the right to evacuate the conveying gear 41 to the right of the needle drop position. With this, the work piece 2 and the interlocking element linked member 13 can be removed from above the throat plate 24.

When the sewing is performed for only one interlocking element linked member 13 of the slide fastener 10 in the slide fastener product 1, the sewing for the other interlocking element linked member 13 is performed. In this case, the other interlocking element linked member 13 is set in the feeding groove 243 of the throat plate 24, the work piece 2 is set so that the front and rear direction of the work piece 2 is reversed from the sewing of the one interlocking element linked member 13, and the sewing of the interlocking element linked member 13 is similarly performed.

As described above, the specific numeric value data for the amount that the needle swinging motor swings the needle to perform the needle drop in the needle drop points a1 to a6, and for the amount moved forward by the conveying motor 42 is stored in advance in the data memory.

In the sewing in which the needle is entered in the needle drop points as shown in FIG. 6 to FIG. 10, the sewing by the zigzag sewing machine 100 can be performed by storing in the data memory in advance the specific numeric value for the amount that the needle swinging motor swings the needle to perform the needle drop in the needle drop points a1 to a6, and the amount moved forward by the conveying motor 42.

Figure 19:
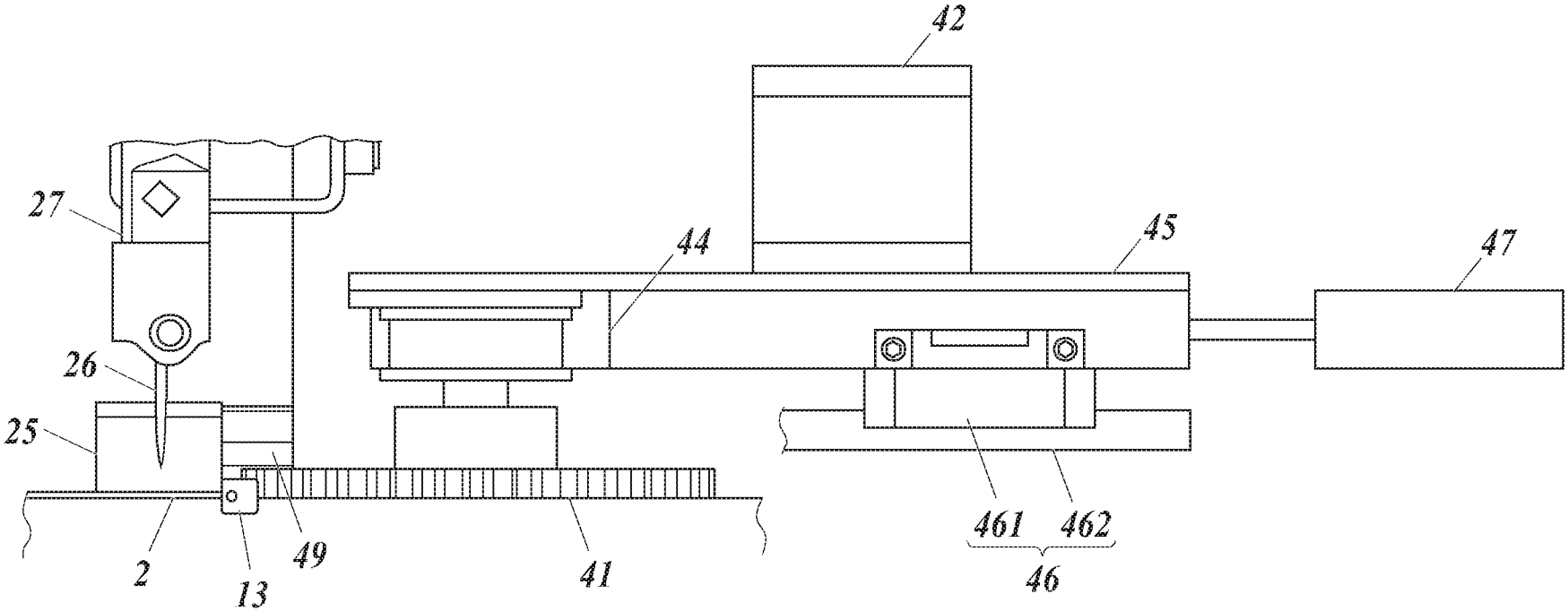
FIG. 19 is a rear view of a conveying mechanism showing an air cylinder which applies movement operation linked to the base plate.

As shown in FIG. 19, an air cylinder 47 can be provided in the sewing machine head 21. Such air cylinder 47 functions as the actuator which performs the movement along the direction to separate the base plate 45 from the needle drop position of the conveying gear 41 by moving the base plate 45 along the X-axis direction. Such air cylinder 47 is provided on the sewing machine head 21 so that the operation direction of the piston rod is parallel with the X-axis direction and the piston rod is linked to the base plate 45.

With this, the base plate 45 can be moved between the defined position for sewing and the evacuated position where the conveying gear 41 is sufficiently separated from the interlocking element linked member 13.

In the air cylinder 47, the electromagnetic valve which performs the moving of the piston rod is controlled by the control apparatus of the zigzag sewing machine 100. Specifically, after the work piece 2 and the interlocking element linked member 13 are set, and the search for the origin of the conveying motor 42 is completed, the base plate 45 is moved to the defined position for sewing when the sewing is started or before the sewing is started, and the base plate 45 is moved to the evacuating position after the sewing ends.

Technical Effect of Embodiment of Invention

According to the example shown in FIG. 2, by sewing performed in the above-described slide fastener product 1, a head portion needle drop point a1 to the head portion 112 side of the interlocking element 11 with relation to the string portion 12, and the end edge portion needle drop points a2 to a6 to the end edge side 2*a* of the work piece 2 with relation to the string portion 12 are formed.

The end edge portion needle drop points a2 and a6 are formed as two positions in one end and the other end of the region R2. The region R2 is in the overlapped portion 2*b* of the work piece 2, within the range of the end edge portion tip 2*aa* side than w/2 which is half of the overlapped width w of the overlapped portion 2*b* in the X-axis direction, and within the range of the inner side of the width of the leg portion 111 of the interlocking element 11 in the Y-axis direction.

The sewing is performed so that the needle thread U and the bobbin thread D of the stitch t1 from the head portion needle drop point a1 to the end edge portion needle drop point a2 and the needle thread U and the bobbin thread D of the stitch t6 from the end edge portion needle drop point a6 to the head portion needle drop point a1 of the adjacent interlocking element 11 (head portion needle drop point a11 in FIG. 2) pass along the sides 116 and 117 on both sides of the leg portion 111 of the interlocking element 11 in the Y-axis direction.

With this, the needle thread U and the bobbin thread D of the stitches t1 and t6 are in contact with the corner on the work piece 2 side of the leg portion 111 in the interlocking element 11 and the interlocking element 11 is held strongly so as to be wrapped. With this, the moving of the interlocking element 11 along the Y-axis direction, the shaking of the head portion 112 of the interlocking element 11 along the Y-axis direction, and the shaking of the head portion 112 of the interlocking element 11 around the Y-axis are reduced and suppressed. Therefore, preferable sewing of the slide fastener 10 can be realized, and the slide fastener product 1 can be smoothly linked or separated by the slider 14.

According to the slide fastener products 1A and 1C shown in the examples of FIG. 8 and FIG. 9, the interlocking element linked member 13 is sewn to the work piece 2 with the end edge portion needle drop point including the above-described end edge portion needle drop points a2 and a6. Similar to the example shown in FIG. 2, the moving of the interlocking element 11 along the Y-axis direction, the shaking of the head portion 112 of the interlocking element 11 along the Y-axis direction, and the shaking of the head portion 112 of the interlocking element 11 around the Y-axis can be reduced and suppressed. Preferable sewing of the slide fastener 10 can be realized, and the slide fastener product 1 can be smoothly linked or separated by the slider 14.

The end edge portion needle drop points a3 to a5 are provided in positions within the region R1 of the overlapped portion 2*b* of the work piece 2 and farther from the interlocking element 11 than the end edge portion needle drop points a2 and a6.

The needle thread U and the bobbin thread D as the sewing thread for the stitches t2 to t5 formed by the end edge portion needle drop points a3 to a5 maintain the close contact state of the cloths of the work piece 2 overlapped in the overlapped portion 2*b*. Therefore, the bend and the deforming in the overlapped portion 2*b* are suppressed.

As a result, the moving of the interlocking element 11 along the Y-axis direction, the shaking of the head portion 112 of the interlocking element 11 along the Y-axis direction and the shaking of the head portion 112 of the interlocking element 11 around the Y-axis can be decreased and suppressed. With this, the slide fastener product 1 can be smoothly linked and separated by the slider 14.

The end edge portion needle drop points a3 to a5 can be provided in the position farther from the interlocking element 11 than the region R1 in the overlapped portion 2*b* of the work piece 2. In this case, the knot between the needle thread U and the bobbin thread D cannot directly maintain the close contact state of the cloths of the work piece 2 in the overlapped portion 2*b*. However, the stitches t2 and t5 press the cloths of the work piece 2 overlapped in the overlapped portion 2*b*. Therefore, the bend and the deforming in the overlapped portion 2*b* can be suppressed.

Specifically, the stitches t1 to t7 are formed by the stitches in the lock stitching. Therefore, a strong knot can be easily formed by adjusting the thread tension. With this, the moving of the interlocking element 11 along the Y-axis direction, the shaking of the head portion 112 of the interlocking element 11 along the Y-axis direction, and the shaking of the head portion 112 of the interlocking element 11 around the Y-axis can be reduced and suppressed. Further, the smooth linking or the separating by the slider 14 can be realized in the slide fastener product 1.

According to the above-described zigzag sewing machine 100, the fastener conveying mechanism 40 includes a conveying gear 41 which includes teeth which interlock with the interlocking elements 11 of the interlocking element linked member 13, a conveying motor 42 which applies rotating operation to the conveying gear 41, and the throat plate 24 which guides the interlocking element linked member 13 in the direction the same as the feeding direction of the work piece 2.

With this, the needle swinging of the sewing needle 26, the conveying of the work piece 2, and the feeding of the interlocking element linked member 13 can be suitably performed in order to determine the position with relation to the above-described needle drop points a1 to a6.

Specifically, in conventional sewing machines, it is difficult to convey objects in which unevenness continues such as the plurality of interlocking elements 11 linked along the conveying direction as in the interlocking element linked member 13. However, according to the zigzag sewing machine 100, the conveying is performed with the teeth of the conveying gear 41 interlocked with the head portions 112 of the continuous interlocking elements 11 in the interlocking element linked member 13. Therefore, the interlocking element linked member 13 can be conveyed accurately to the target position desired by the user.

Therefore, the needle drop can be accurately performed in the needle drop points a1 to a6, and the sewing of the interlocking element linked member 13 to the work piece 2 can be performed preferably.

The throat plate 24 as the fastener guide includes the feeding groove 243 which guides the plurality of interlocking elements 11 of the interlocking element linked member 13 along the same direction as the feeding direction of the work piece 2. Therefore, when the head portion 112 of the interlocking element 11 interlocks with the teeth of the conveying gear 41, the interlocking element linked member 13 stably maintains the feeding direction, and the needle drop can be performed accurately in the needle drop points a1 to a6.

The zigzag sewing machine 100 includes a fastener presser foot 49 which prevents the interlocking element linked member 13 conveyed by the conveying gear 41 from floating upward. Therefore, when the head portion 112 of the interlocking element 11 interlocks with the teeth of the conveying gear 41, the interlocking element linked member 13 can be stably maintained so as not to float upwards, and the needle drop can be performed more accurately in the needle drop points a1 to a6.

The conveying gear 41 is supported by the supporting arm 44 to be able to move along the direction to be separated from the needle drop position. Therefore, the interlocking element linked member 13 can be easily detached from the throat plate 24, and the workability is enhanced.

The conveying gear 41 is supported by the conveying motor 42, the transmission mechanism 48, and the base plate 45, and is supported by the slide guide 46 to be able to move along the direction in which the conveying gear 41 separates from the needle drop position. Therefore, the interlocking element linked member 13 can be easily removed from the throat plate 24, and the workability is enhanced.

Further, since the conveying gear 41 is moved together with the conveying motor 42 and the transmission mechanism 48, it is possible to suppress the origin position of the conveying gear 41 from being displaced during the movement. Therefore, when returning to the sewing after separating from the needle drop position, the origin search is omitted, and the next sewing can be performed immediately. With this, the efficiency of operation is enhanced.

When the movement for the conveying gear 41 by the base plate 45 is performed with the air cylinder 47 as the actuator, manual operation is not necessary. The burden of operation is reduced and the operation can be performed speedily.

The zigzag sewing machine 100 includes a control apparatus which drives the conveying motor 42 at the timing defined based on the detection of the encoder of the sewing machine motor for each needle drop to move the interlocking element linked member 13 in the feeding direction in the movement amount to the next needle drop point. With this, regarding the conveying direction of the interlocking element linked member 13, the interlocking element linked member 13 can be conveyed to the needle drop point as the goal in the sewing on the work piece 2, and the suitable sewing can be performed easily.

The zigzag sewing machine 100 includes a control apparatus which drives the needle swinging motor at a timing defined based on the detection of the encoder of the sewing machine motor for each needle drop to swing the sewing needle in the needle swinging amount to the next needle drop point. With this, regarding the direction orthogonal to the conveying direction of the interlocking element linked member 13, the sewing needle can be moved to the needle drop point as the goal in the sewing on the work piece 2, and the suitable sewing can be performed easily.

[Others]

The structure of the head portion 112 of the interlocking element 11 in the interlocking element linked members 13 of the slide fasteners 10 is not limited to the structure shown in FIG. 4. For example, various structures for the head portion of the interlocking element used in a typical slide fastener can be applied.

If the feeding adjustment motor is provided in the cloth feeding mechanism and the feeding amount is adjusted by the feeding adjustment motor at the timing defined based on the detection of the encoder of the sewing machine motor, in addition to the needle swinging amount of the needle swinging motor to perform the needle drop in the needle drop points, and the forward movement amount of the conveying motor 42, specific numeral value data of the feeding amount by the feeding adjustment motor set for the work piece is prepared in the data memory in advance. With this, the sewing of the interlocking element linked members by the zigzag sewing machine 100 can be performed preferably.

INDUSTRIAL APPLICABILITY

The present invention can be applied to sewing the slide fastener in which the interlocking elements are linked with a string portion.

REFERENCE SIGNS LIST

1, 1A, 1B slide fastener product
2 work piece
2*a* end edge portion
2*b* overlapped portion
10 slide fastener
11 interlocking element
12 string portion
13 interlocking element linked member
14 slider
20 sewing machine frame
24 throat plate (fastener guide)
26 sewing needle
40 fastener conveying mechanism
41 conveying gear
42 conveying motor
45 base plate
46 slide guide
47 air cylinder (actuator)
100 zigzag sewing machine (sewing machine)
111 leg portion
112 head portion
116, 117 side
242 needle eyelet
243 feeding groove
413 origin sensor
414 detection plate
a1, a11 head portion needle drop point
a2 to a6 end edge portion needle drop point
D bobbin thread (sewing thread)
R1, R2 region
t1 to t7 stitch
U needle thread (sewing thread)

The invention claimed is:

1. A method for sewing a slide fastener to sew an interlocking element linked member of the slide fastener to an end edge portion of a work piece, the slide fastener including the interlocking element linked member in which a plurality of interlocking elements are linked with a string portion, the interlocking element including a leg portion supported by the string portion and a head portion which interlocks with an interlocking element of another interlocking element linked member as a pair and which projects from the leg portion, and the sewing method comprising:

by sewing, forming a head portion needle drop point on a head portion side of the interlocking element with relation to the string portion and end edge portion needle drop points on an end edge portion side of the work piece with relation to the string portion, the end edge portion needle drop points being provided in at least two positions, the at least two positions comprising a first end portion and a second end portion, and the first end portion and the second end portion being provided within an overlapped portion at which the work piece is folded, within a range toward a tip side of the end edge portion relative to a position that is half of an overlapped width in the overlapped portion along a projecting direction of the head portion of the interlocking element, and within a range on an inner side of a width of the leg portion of the interlocking element in a longitudinal direction of the string portion; and sewing in which sewing thread passing from the head portion needle drop point to the end edge portion needle drop point of the first end portion and sewing thread passing from the end edge portion needle drop point of the second end portion to the head portion needle drop point of an adjacent interlocking element each pass a respective one of sides of the leg portion of the interlocking element in the longitudinal direction of the string portion.

2. The method according to claim 1, wherein:

the slide fastener includes a pair of interlocking element linked members and a slider which links and separates the pair of interlocking element linked members, and the end edge portion needle drop point provided in the first end portion and the end edge portion needle drop point provided in the second end portion are provided within a range in which the slider passes over the work piece.

3. The method according to claim 2, wherein a stitch of the sewing is formed by a stitch of lock stitching.

4. The method according to claim 1, wherein a stitch of the sewing is formed by a stitch of lock stitching.

5. The method according to claim 4, wherein the stitch of the lock stitching is formed by zigzag sewing.

6. A method for sewing a slide fastener to sew an interlocking element linked member of the slide fastener to an end edge portion of a work piece, the slide fastener including the interlocking element linked member in which a plurality of interlocking elements are linked with a string portion, the interlocking element including a leg portion supported by the string portion and a head portion which interlocks with an interlocking element of another interlocking element linked member as a pair and which projects from the leg portion, and the sewing method comprising:

by sewing, forming a head portion needle drop point on a head portion side of the interlocking element with relation to the string portion and end edge portion needle drop points on an end edge portion side of the work piece with relation to the string portion, the end edge portion needle drop points being provided in positions comprising (i) two positions comprising a first end portion and a second end portion, the first end portion and the second end portion being provided in a range on an inner side of a width of the leg portion of the interlocking element in the longitudinal direction of the string portion, and (ii) a position which is in a range farther from the interlocking element than the first and second end portions and which is in the range on the inner side of the width of the leg portion of the interlocking element; and sewing in which sewing thread from the head portion needle drop point to the end edge portion needle drop point provided in the first end portion and sewing thread from the end edge portion needle drop point provided in the second end portion to the head portion needle drop point of an adjacent interlocking element each pass a respective one of sides of the leg portion of the interlocking element in a longitudinal direction of the string portion.

7. The method according to claim 6, wherein the end edge needle drop point is within an overlapped portion at which the work piece is folded.

8. The method according to claim 7, wherein:

the slide fastener includes a pair of interlocking element linked members and a slider which links and separates the pair of interlocking element linked members, and the end edge portion needle drop point provided in the first end portion and the end edge portion needle drop point provided in the second end portion are provided within a range in which the slider passes over the work piece.

9. The method according to claim 7, wherein a stitch of the sewing is formed by a stitch of lock stitching.

10. The method according to claim 6, wherein:

the slide fastener includes a pair of interlocking element linked members and a slider which links and separates the pair of interlocking element linked members, and the end edge portion needle drop point provided in the first end portion and the end edge portion needle drop point provided in the second end portion are provided within a range in which the slider passes over the work piece.

11. The method according to claim 6, wherein a stitch of the sewing is formed by a stitch of lock stitching.

12. A slide fastener product comprising:

a slide fastener including:

a pair of interlocking element linked members in which a plurality of interlocking elements are linked with a string portion; and a slider in which the pair of interlocking element linked members are linked and separated, and a work piece including an end edge portion, wherein:

each interlocking element linked member in the pair of interlocking element linked members is sewn separately in one of two positions of the end edge portion, the interlocking element includes a leg portion supported by the string portion and a head portion which interlocks with an interlocking element of another interlocking element linked member as a pair and which projects from the leg portion, a head portion needle drop point is formed by sewing on a head portion side of the interlocking element with relation to the string portion and end edge portion needle drop points are formed by sewing on an end edge portion side of the work piece with relation to the string portion, the end edge portion needle drop points are provided in at least two positions, the at least two positions comprising a first end portion and a second end portion, and the first end portion and the second end portion being provided within an overlapped portion at which the work piece is folded, within a range toward a tip side of the end edge portion relative to a position that is half of an overlapped width in the overlapped portion along a projecting direction of the head portion of the interlocking element, and within a range on an inner side of a width of the leg portion of the interlocking element in a longitudinal direction of the string portion, and sewing thread passing from the head portion needle drop point to the end edge portion needle drop point of the first end portion and sewing thread passing from the end edge portion needle drop point of the second end portion to the head portion needle drop point of an adjacent interlocking element each pass a respective one of sides of the leg portion of the interlocking element.

13. The slide fastener product according to claim 12, wherein the end edge portion needle drop point provided in the first end portion and the end edge portion needle drop point provided in the second end portion are provided within a range in which the slider passes over the work piece.

14. The slide fastener product according to claim 13, wherein a stitch of the sewing is formed by a stitch of lock stitching.

15. The slide fastener product according to claim 12, wherein a stitch of the sewing is formed by a stitch of lock stitching.

16. The slide fastener product according to claim 15, wherein the stitch of the lock stitching is formed by zigzag sewing.

17. A slide fastener product comprising:

a slide fastener including:

a pair of interlocking element linked members in which a plurality of interlocking elements are linked with a string portion; and a slider in which the pair of interlocking element linked members are linked and separated, and a work piece including an end edge portion, wherein:

each interlocking element linked member in the pair of interlocking element linked members is sewn separately in one of two positions of the end edge portion, the interlocking element includes a leg portion supported by the string portion and a head portion which interlocks with an interlocking element of another interlocking element linked member as a pair and which projects from the leg portion, a head portion needle drop point is formed by sewing on a head portion side of the interlocking element with relation to the string portion and end edge portion needle drop points are formed by sewing on an end edge portion side of the work piece with relation to the string portion, the end edge portion needle drop points are provided in positions comprising (i) two positions comprising a first end portion and a second end portion, the first end portion and the second end portion being provided in a range on an inner side of a width of the leg portion of the interlocking element in the longitudinal direction of the string portion, and (ii) a position which is in a range farther from the interlocking element than the first and second end portions and which is in the range on the inner side of the width of the leg portion of the interlocking element, and sewing thread from the head portion needle drop point to the end edge portion needle drop point provided in the first end portion and sewing thread from the end edge portion needle drop point provided in the second end portion to the head portion needle drop point of an adjacent interlocking element each pass a respective one of sides of the leg portion of the interlocking element.

18. The slide fastener product according to claim 17, wherein the end edge needle drop point is within an overlapped portion at which the work piece is folded along the end edge portion.

19. The slide fastener product according to claim 18, wherein the end edge portion needle drop point provided in the first end portion and the end edge portion needle drop point provided in the second end portion are provided within a range in which the slider passes over the work piece.

20. The slide fastener product according to claim 18, wherein a stitch of the sewing is formed by a stitch of lock stitching.

21. The slide fastener product according to claim 17, wherein the end edge portion needle drop point provided in the first end portion and the end edge portion needle drop point provided in the second end portion are provided within a range in which the slider passes over the work piece.

22. The slide fastener product according to claim 17, wherein a stitch of the sewing is formed by a stitch of lock stitching.

* * * * *